US009334676B2

(12) United States Patent
Lambrou et al.

(10) Patent No.: US 9,334,676 B2
(45) Date of Patent: May 10, 2016

(54) LOCK ASSEMBLY

(75) Inventors: Harris Lambrou, Blackburn (AU); Ian Bartos, Blackburn (AU)

(73) Assignee: GAINESBOROUGH HARDWARE INDUSTRIES LIMITED, Blackburn, Victoria (AU)

( * ) Notice: Subject to any disclaimer, the term of this patent is extended or adjusted under 35 U.S.C. 154(b) by 361 days.

(21) Appl. No.: 13/808,083

(22) PCT Filed: Jun. 20, 2011

(86) PCT No.: PCT/AU2011/000745

§ 371 (c)(1), (2), (4) Date: Mar. 21, 2013

(87) PCT Pub. No.: WO2012/006658

PCT Pub. Date: Jan. 19, 2012

(65) Prior Publication Data

US 2013/0192319 A1 Aug. 1, 2013

(30) Foreign Application Priority Data

Jul. 15, 2010 (AU) ..... 20101093161

(51) Int. Cl.

*E05B 47/06* (2006.01)
*E05B 63/16* (2006.01)
*E05B 47/00* (2006.01)

(52) U.S. Cl.

CPC ..... *E05B 47/0657* (2013.01); *E05B 47/0673* (2013.01); *E05B 63/16* (2013.01); (Continued)

(58) Field of Classification Search

CPC ..... E05B 47/06; E05B 47/09; E05B 63/04; E05B 63/08; E05B 2047/0073; E05B 2047/0076; E05B 47/0657; E05B 13/004; E05B 47/0001; E05B 47/0661; E05B 3/12; Y10T 292/0836; Y10T 292/084; Y10T 292/1021; Y10T 70/713

USPC ..... 70/107

See application file for complete search history.

(56) References Cited

U.S. PATENT DOCUMENTS 3,872,696 A * 3/1975 Geringer ..... 70/145
5,259,652 A * 11/1993 Adams et al. ..... 292/169.14

(Continued)

FOREIGN PATENT DOCUMENTS

| | | |
|---|---|---|
| GB | 2123078 A | 1/1984 |
| WO | 9601355 | 1/1996 |
| WO | 2010022457 | 3/2010 |

OTHER PUBLICATIONS

International Search Report for PCT Application No. PCT/AU2011/000745 mailed Sep. 20, 2011.

(Continued)

*Primary Examiner* — Suzanne Barrett

(74) *Attorney, Agent, or Firm* — Neal, Gerber & Eisenberg LLP

(57) ABSTRACT

An electrically controllable lock assembly (20) including a lock bolt (28), a first hub (36), a second hub (68), a first hub locker (64), a second hub locker (72), a first driver (62) and a second driver (70). The lock bolt (28) is movable between a latching position and an unlatching position. The first hub (36) is adapted to move the lock bolt (28) in response to movement of a first handle. The second hub (68) is adapted to move the lock bolt (28) in response to movement of a second handle. The first hub locker (64) is positionable to selectively prevent or allow movement of the lock bolt (28) in response to torque being applied to the first hub (36) from the first handle. The second hub locker (72) is positionable to selectively prevent or allow movement of the lock bolt (28) in response to torque being applied to the second hub (68) from the second handle. The first driver (62) is electrically controllable to position the first hub locker (64) to thereby selectively prevent or allow movement of the lock bolt (28) in response to torque being applied to the first hub (36) from the first handle and the second driver (70) is electrically controllable to position the second hub locker (72) to thereby selectively prevent or allow movement of the lock bolt (28) in response to torque being applied to the second hub (68) from the second handle.

22 Claims, 21 Drawing Sheets

(52) U.S. Cl.
CPC .... *E05B 47/0004* (2013.01); *E05B 2047/0007* (2013.01); *E05B 2047/0073* (2013.01); *E05B 2047/0076* (2013.01); *Y10T 70/713* (2015.04)

(56) References Cited

U.S. PATENT DOCUMENTS

| | | | | |
|---|---|---|---|---|
| 5,678,870 | A * | 10/1997 | Pelletier | 292/244 |
| 5,820,177 | A * | 10/1998 | Moon | 292/335 |
| 5,884,515 | A * | 3/1999 | Milman | 70/472 |
| 5,953,942 | A * | 9/1999 | Doucet et al. | 70/283 |
| 6,145,353 | A * | 11/2000 | Doucet | 70/277 |
| 6,578,888 | B1 * | 6/2003 | Fayngersh et al. | 292/332 |
| 6,581,423 | B2 * | 6/2003 | Lin | 70/107 |
| 6,978,646 | B2 * | 12/2005 | Raatikainen | 70/472 |
| 7,497,486 | B1 * | 3/2009 | Davis et al. | 292/32 |
| 8,079,238 | B2 * | 12/2011 | Lin | 70/107 |
| 8,201,858 | B1 * | 6/2012 | Moon et al. | 292/164 |
| 8,234,892 | B2 * | 8/2012 | Laverty et al. | 70/107 |
| 8,292,336 | B2 * | 10/2012 | Moon | 292/61 |
| 2005/0199026 | A1 * | 9/2005 | Geringer et al. | 70/283 |
| 2007/0113603 | A1 * | 5/2007 | Polster | 70/107 |
| 2013/0055775 | A1 * | 3/2013 | Bartos | 70/357 |
| 2013/0192319 | A1 * | 8/2013 | Lambrou et al. | 70/283 |
| 2013/0298617 | A1 * | 11/2013 | Lambrou et al. | 70/279.1 |
| 2014/0175807 | A1 * | 6/2014 | Lambrou et al. | 292/92 |
| 2014/0175810 | A1 * | 6/2014 | Lambrou et al. | 292/144 |

OTHER PUBLICATIONS

International Preliminary Report on Patentablity for PCT Application No. PCT/US2011/000745 mailed Aug. 1, 2012.

* cited by examiner

Lock-Wiring Function Matrix

| Solenoid Wiring | Possible Lock Side Function Pairs (Electric Control Any Time) First Side | Second Side | Failsafe / Failsecure Setting (Set at Installation) First Side | Second Side | Flexibility Note | Plug Function /Wiring Required |
|---|---|---|---|---|---|---|
| **The Current Electric Mortice Alternative** | | | | | | |
| 1 Wire<br>1 Solenoid | Unlocked | Unlocked | Fail Safe | Fail Safe | Function of lock sides must change together<br>Second Side of lock can only ever be left unlocked<br>First Side of lock can only ever be left unlocked | Current Industry Standard Plug and wiring loom - 1 pin 1 wire for solenoid operation |
| | Locked | Locked | | | | |
| | Locked | Locked | Fail Secure | Fail Secure | | |
| | Unlocked | Unlocked | | | | |
| | Locked | Always Unlocked | Fail Secure | Always Unlocked | | |
| | Unlocked | Always Unlocked | | | | |
| | Unlocked | Always Unlocked | Fail Safe | Always Unlocked | | |
| | Locked | Always Unlocked | | | | |
| | Always Unlocked | Locked | Always Unlocked | Fail Secure | | |
| | Always Unlocked | Unlocked | | | | |
| | Always Unlocked | Unlocked | Always Unlocked | Fail Safe | | |
| | Always Unlocked | Locked | | | | |

| | Possible Locked / Unlocked States (Electric Control Any Time) First Side | Second Side | Failsafe / Failsecure Setting (Set at Installation) First Side | Second Side | | |
|---|---|---|---|---|---|---|
| **Lock assembly shown in Fig. 1** | | | | | | |
| 2 Wires<br>2 Solenoids | Locked | Locked | Fail Secure | Fail Secure | Any Locked / Unlocked State, any side, any time | New plug with at least one extra pin, extra circuit wire also in wiring loom through to control monitoring |
| | Locked | Unlocked | | | | |
| | Unlocked | Locked | | | | |
| | Unlocked | Unlocked | | | | |
| | Locked | Locked | Fail Secure | Fail Safe | | |
| | Locked | Unlocked | | | | |
| | Unlocked | Locked | | | | |
| | Unlocked | Unlocked | | | | |
| | Locked | Locked | Fail Safe | Fail Secure | | |
| | Locked | Unlocked | | | | |
| | Unlocked | Locked | | | | |
| | Unlocked | Unlocked | | | | |
| | Locked | Locked | Fail Safe | Fail Safe | | |
| | Locked | Unlocked | | | | |
| | Unlocked | Locked | | | | |
| | Unlocked | Unlocked | | | | |
| 1 Wire<br>2 Solenoids | Unlocked | Unlocked | Fail Safe | Fail Safe | Both solenoids connected - Locked / Unlocked State of both sides must change together but any State can be selected for any side at any time | Piggy Back adapter plug, 2 wires in new lock jacked to 1 wire from current standard wiring loom or wiring loom termination changed |
| | Locked | Locked | | | | |
| | Locked | Locked | Fail Secure | Fail Secure | | |
| | Unlocked | Unlocked | | | | |
| | Unlocked | Locked | Fail Safe | Fail Secure | | |
| | Locked | Unlocked | | | | |
| | Locked | Unlocked | Fail Secure | Fail Safe | | |
| | Unlocked | Locked | | | | |
| 1 Wire<br>Work First Side solenoid only | Locked | Always Locked | Fail Secure | Always Locked | Second Side solenoid not connected - Permanent Second Side Locked State set at installation only but the First Side can adopt any Locked / Unlocked State at any time | Piggy Back adapter plug, wire to First Side solenoid only is connected to current standard wiring loom or wiring loom termination changed |
| | Unlocked | Always Locked | | | | |
| | Unlocked | Always Locked | Fail Safe | Always Locked | | |
| | Locked | Always Locked | | | | |
| | Locked | Always Unlocked | Fail Secure | Always Unlocked | | |
| | Unlocked | Always Unlocked | | | | |
| | Unlocked | Always Unlocked | Fail Safe | Always Unlocked | | |
| | Locked | Always Unlocked | | | | |
| 1 Wire<br>Work Second Side solenoid only | Always Locked | Locked | Always Locked | Fail Secure | First Side solenoid not connected - Permanent First Side Locked State set at installation only but the Second Side can adopt any Locked / Unlocked State at any time | Piggy Back adapter plug, wire to Second Side solenoid only is connected to current standard wiring loom or wiring loom termination changed |
| | Always Locked | Unlocked | | | | |
| | Always Locked | Unlocked | Always Locked | Fail Safe | | |
| | Always Locked | Locked | | | | |
| | Always Unlocked | Locked | Always Unlocked | Fail Secure | | |
| | Always Unlocked | Unlocked | | | | |
| | Always Unlocked | Unlocked | Always Unlocked | Fail Safe | | |
| | Always Unlocked | Locked | | | | |

FIG. 16

Lock-Wiring Function Matrix - 1 Solenoid

| | Possible Lock Side Function Pairs (Electric Control Any Time) | | Failsafe / Failsecure Setting (Set at Installation) | | |
|---|---|---|---|---|---|
| Solenoid Wiring | First Side | Second Side | First Side | Second Side | Flexibility Note |
| The Current Electric Mortice Alternative | | | | | |
| 1 Wire<br>1 Solenoid | Unlocked | Unlocked | Fail Safe | Fail Safe | Function of lock sides must change together |
| | Locked | Locked | | | |
| | Locked | Locked | Fail Secure | Fail Secure | |
| | Unlocked | Unlocked | | | |
| | Locked | Always Unlocked | Fail Secure | Always Unlocked | |
| | Unlocked | Always Unlocked | | | |
| | Unlocked | Always Unlocked | Fail Safe | Always Unlocked | |
| | Locked | Always Unlocked | | | |
| | Always Unlocked | Locked | Always Unlocked | Fail Secure | Second Side of lock can only ever be left unlocked |
| | Always Unlocked | Unlocked | | | |
| | Always Unlocked | Unlocked | Always Unlocked | Fail Safe | First Side of lock can only ever be left unlocked |
| | Always Unlocked | Locked | | | |

| | Possible Locked / Unlocked States (Electric Control Any Time) | | Failsafe / Failsecure Setting (Set at Installation) | | |
|---|---|---|---|---|---|
| | First Side | Second Side | First Side | Second Side | |
| Lock assembly shown in Fig. 17 | | | | | |
| 1 Wire<br>1 Solenoid<br>Both<br>Hub Lockers<br>working | Unlocked | Unlocked | Fail Safe | Fail Safe | Both Hub Lockers connected - Locked / Unlocked State of both sides must change together but any state can be selected for any side at any time |
| | Locked | Locked | | | |
| | Locked | Locked | Fail Secure | Fail Secure | |
| | Unlocked | Unlocked | | | |
| | Unlocked | Locked | Fail Safe | Fail Secure | |
| | Locked | Unlocked | | | |
| | Locked | Unlocked | Fail Secure | Fail Safe | |
| | Unlocked | Locked | | | |
| 1 Wire<br>1 Solenoid<br>Work First Side<br>Hub Locking<br>only | Locked | Always Locked | Fail Secure | Always Locked | Second Side hub locker not connected - Permanent Second Side lock Function set at installation only but the First Side can adopt any Locked / Unlocked State at any time |
| | Unlocked | Always Locked | | | |
| | Unlocked | Always Locked | Fail Safe | Always Locked | |
| | Locked | Always Locked | | | |
| | Locked | Always Unlocked | Fail Secure | Always Unlocked | |
| | Unlocked | Always Unlocked | | | |
| | Unlocked | Always Unlocked | Fail Safe | Always Unlocked | |
| | Locked | Always Unlocked | | | |
| 1 Wire<br>1 Solenoid<br>Work Second Side<br>Hub Locking<br>only | Always Locked | Locked | Always Locked | Fail Secure | First Side hub locker not connected - Permanent First Side lock Function set at installation only but the Second Side can adopt any Locked / Unlocked State at any time |
| | Always Locked | Unlocked | | | |
| | Always Locked | Unlocked | Always Locked | Fail Safe | |
| | Always Locked | Locked | | | |
| | Always Unlocked | Locked | Always Unlocked | Fail Secure | |
| | Always Unlocked | Unlocked | | | |
| | Always Unlocked | Unlocked | Always Unlocked | Fail Safe | |
| | Always Unlocked | Locked | | | |

FIG. 21

LOCK ASSEMBLY

CROSS-REFERENCE TO RELATED APPLICATIONS

This is a national stage patent application of PCT/AU2011/000745, filed on Jun. 20, 2011, that claims priority from Australian Patent Application No. 2010903161, filed Jul. 15, 2010, both of which are incorporated by reference in their entirety.

FIELD OF THE INVENTION

The present invention relates to a lock assembly.

The invention has been primarily developed in relation to a mortice lock assembly for a door and will be described hereinafter with reference to that application. However, the invention can also be used in other types of lock assemblies, including surface mounted locks.

BACKGROUND OF THE INVENTION

Mechanically controllable mortice locks utilise two hubs, each associated with a lever or other handle on each side of a door. They can be configured to provide any one only of four different pairs of functions when locked or unlocked, as follows:

(Pair 1) Unlocked function—door can be opened for entry or egress from either side without key. Locked function—door can be opened for entry without key but key needed for egress (i.e. by unlocking or by latch retracting/key over-riding without unlocking);

(Pair 2) Unlocked function—door can be opened for entry or egress from either side without key. Locked function—door can be opened for egress without key but key needed for entry;

(Pair 3) Unlocked function—door can be opened for entry or egress from either side without key. Locked function—key needed for entry and egress; or (Pair 4) Unlocked function—door can be opened for entry or egress from either side without key. Locked function—door can be opened for entry or egress from either side without key (effectively creating a latch).

Configuring a lock in the desired one of the four above function pairs is known as handing the locking mechanism and allows the lock installer to ensure that the pair of functions best matches the requirement of a particular door. The ability to hand a lock: saves a lock manufacturer from having to make, stock and sell four different locks, one for each of the above four pairs of functions; saves a customer from having to know which parts to order for which door; and avoids an incorrectly handed lock from being delivered. These last two requirements can be particularly important when purchasing a large number of locks for installation in, for example, a multi-story building with many doors. Handing is done by adjusting or manipulating one or more of the lock's components.

A disadvantage of known mechanically controllable locks is that once the lock is handed (ie. the function that each side of the lock is able to offer is selected) the lock can only operate to offer that selected one pair of functions. Accordingly, if a first side of a lock is required to be free egress when the lock is locked and a second side of the lock is required to be locked when the lock is locked, then that first side can never be locked unless the lock is accessed and the handing changed. To do this the lock must be removed from the door (or otherwise physically accessed) to change the handing to a different one of the function pairs.

Electrically controllable mortice locks, which can be locked and unlocked with an electrical signal (ie. instead of a key) are also known. Such locks can similarly only be handed to provide one of the above pairs of functions. They also suffer from the disadvantage that the lock must be removed from the door (or otherwise physically accessed) to change the handing to different one of the function pairs.

However, in some mechanical and electrical lock installations, a change in the function of the lock is desirable or necessary without accessing the lock. For example, a door may require a business hours locked function of egress without key/signal but key/signal needed for entry and an after hours locked function of key/signal needed for entry and egress. As the handing can not be changed without removing/accessing the lock, such changes of functionality during normal use are not possible with any single existing lock. With mechanical mortice locks, such changes of functionality are achieved by installing a separate deadbolt on the same door for after hours use. With an electrical mortice lock, a separate electromagnetic lock is installed on the same door for after hours use. Both of these approaches have increased product and installation costs. The associated electrical systems also have increased system and control complexity.

Electrically controllable mortice locks must also be set to operate in either a fail safe condition, in which they lock a door when energised and unlock a door when de-energised, or a fail secure condition, in which they unlock a door when energised and lock a door when de-energised. This allows access through a door in the event of a power failure to be predetermined as allowed or prevented in accordance with safety and security requirements.

Known electrically controllable mortice locks can only be handed into one of the four handing function pairs described above. Further, such locks can only be set to fail safe to the unlocked function that has been selected for the door during handing or to fail secure to the locked function that has been selected for the door during handing. Accordingly, if a lock is set to fail secure and during normal operation (ie. power is available) a first side of the lock is required to be free egress when the lock is locked while a second side is required to be locked when the lock is locked, then that first side can never be locked during a power failure unless the lock is accessed and the handing (function pair) changed. Put another way, the locking of both sides can not be done.

For example, during normal operation (i.e. with power available) a door may require a locked function of egress without key/signal but key/signal needed for entry and a failsecure (ie. power failure) locked function on both sides of the door. As the handing can not be changed without removing/accessing the lock, such change of functionality is not practical with any existing electrical mortice lock. A separate, failsecure electromagnetic lock is installed on the same door for power failure conditions. This approach has increased product and installation costs. The electrical systems also have increased system and control complexity.

OBJECT OF THE INVENTION

It is an object of the invention to substantially overcome or at least ameliorate one or more of the above disadvantages.

SUMMARY OF THE INVENTION

Accordingly, in a first aspect, the present invention provides an electrically controllable lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a first driver electrically controllable to position the first hub locker to thereby selectively prevent or allow movement of the lock bolt in response to torque being applied to the first hub from the first handle; and a second driver metrically controllable to position the second hub locker to thereby selectively prevent or allow movement of the lock bolt in response to torque being applied to the second hub from the second handle.

The first driver and the second driver are preferably electrically controllable independently of one another.

The first driver and the second driver are preferably controllable independently of one another in response to respective first and second power signals each associated with respective first and second control signals. In this embodiment, the lock assembly is suitable for connection to a 2 control wire loom with the first and second control signals being provided by respective first and second wires.

The first driver and the second driver are preferably electrically controllable in tandem with one another.

The first driver and the second driver are preferably controllable in tandem with one another in response to respective first and second power signals both associated with a single control signal. In this embodiment, the lock assembly is suitable for connection to a 1 control wire loom with the single control signal being provided by a single wire.

The lock assembly is preferably reconfigurable between the first driver and the second driver being electrically controllable independently of one another and the first driver and the second driver being electrically controllable in tandem with one another.

In a preferred form, the lock assembly includes a housing and the first driver and the second driver are both positioned within the housing. In one alternate form, the lock assembly includes a first escutcheon on one side of the housing and a second escutcheon of the other side of the housing and one of the first driver or the second driver are positioned within the housing and the other of the first driver or the second driver are positioned external the housing and within one of the first or the second escutcheons. In another alternate form, the lock assembly includes a first escutcheon on one side of the housing and a second escutcheon of the other side of the housing and the first driver is positioned external the housing and within the first escutcheon and the second driver is positioned external the housing and within the second escutcheon.

In one form, the lock assembly is preferably adapted to energise the first and second drivers in response to first and second control signals respectively.

In another form, the lock assembly preferably includes a switch arrangement adapted to enable or disable the energising of the first driver and/or the second driver in response to first and/or second control signals respectively. The switch arrangement is preferably on the exterior of the housing, most preferably on a surface adjacent the latch beneath a face plate.

In a yet further form, the switch arrangement is adapted to allow: first and second control signals applied to first and second control wires to be communicated to the first and second drivers respectively; or the first and second control signals applied to the first and second control wires to be communicated to the second and first drivers respectively.

The first hub locker is preferably positionable at an advanced position, preventing movement of the lock bolt in response to torque being applied to the first hub from the first handle, or a withdrawn position, allowing movement of the lock bolt in response to torque being applied to the first hub from the first handle.

The second hub locker is preferably positionable at an advanced position, preventing movement of the lock bolt in response to torque being applied to the second hub from the second handle, or a withdrawn position, allowing movement of the lock bolt in response to torque being applied to the second hub from the second handle.

The first driver and the second driver are preferably both biased in a direction opposite to their driven direction. More preferably, first driver and the second driver are biased by a spring, an elastic band, gravity, a motor, a solenoid, a magnetic force, an electromagnetic force, an electrostatic force, or any other force supplying or storage means.

The first hub locker and the first driver are preferably settable as either fail safe—or fail secure and the second hub locker and the second driver are preferably settable as either fail safe or fail secure, wherein the fail setting of the first hub locker and the first driver and the fail setting of the second hub locker and the second driver are independent of one another.

The first hub locker and the first driver are preferably set as fail secure and the second hub locker and the second driver are preferably set as fail secure, whereby:

the first driver is energised to drive the first hub locker from the advanced position to the withdrawn position and the second driver is energised to drive the second hub locker from advanced position to the withdrawn position; or the first driver and the first hub locker are biased from the withdrawn position to the advanced position and the second driver and the second hub locker are biased from the withdrawn position to the advanced position.

The first hub locker and the first driver are preferably set as fail safe and the second hub locker and the second driver are preferably set as fail secure, whereby:

the first driver energised to drive the first hub locker from the withdrawn position to the advanced position and the second driver is energised to drive the second hub locker from advanced position to the withdrawn position; or the first driver and the first hub locker are biased from the advanced position to the withdrawn position and the second driver and the second hub locker are biased from the withdrawn position to the advanced position.

The first hub locker and the first driver are preferably set as fail secure and the second hub locker and the second driver are preferably set as fail safe, whereby:

the first driver is energised to drive the first hub locker from the advanced position to the withdrawn position and the second driver is energised to drive the second hub locker from the withdrawn position to the advanced position; or the first driver and the first hub locker are biased from the withdrawn position to the advanced position and the second driver and the second hub locker are biased from the advanced position to the withdrawn position.

The first hub locker and the first driver are preferably set as fail safe and the second hub locker and the second driver are preferably set as fail safe, whereby:

the first driver is energised to drive the first hub locker from the withdrawn position to the advanced position and the second driver is energised to drive the second hub locker from withdrawn position to the advanced position; or the first driver and the first hub locker are biased from the advanced position to the withdrawn position and the second driver and the second hub locker are biased from the advanced position to the withdrawn position.

The first and second drivers are preferably in the form of a solenoid, a motor, a gravity driven device, a spring, an elastic band, a magnetic force, an electromagnetic force, an electrostatic force or any other force supplying or storage means.

The first driver is preferably an electrically powered pull type solenoid with a spring biased return. The second driver is preferably an electrically powered pull type solenoid with a spring biased return.

Alternatively, the first driver is an electrically powered push type solenoid with a spring biased return. The second driver is preferably an electrically powered push type solenoid with a spring biased return.

Further alternatively, the first driver is an electrically powered pull type solenoid with a spring biased return. Alternatively, the second driver is preferably an electrically powered push type solenoid with a spring biased return.

Yet further alternatively, the first driver is an electrically powered push type solenoid with a spring biased return. Alternatively, the second driver is preferably an electrically powered pull type solenoid with a spring biased return.

The lock assembly preferably includes:

a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second driver causes the second hub locker to move in a first direction, or a second position in which energising of the second driver causes the second hub locker to move in a second direction, opposite to the first direction.

The first motion transfer means preferably includes:

a first driving part connectable to the first driver, the first driving part includes a first connection point and a second connection point; and a first driven part connectable to the first hub locker, the first driven part being pivotally mounted relative to the housing at a first pivot point and including a first connection point and a second connection point;

wherein, connection of the first connection points of the first driving part and the first driven part causes the first driven part to pivot about the first pivot point in a first direction in response to movement of the first driving part towards the first driven part, and connection of the second connection points of the first driving part and the first driven part causes the first driven part to pivot about the first pivot point in a second direction, opposite to the first direction, in response to movement of the first driving part towards the first driven part.

The second motion transfer means preferably includes:

a second driving part connectable to the second driver, the second driving part includes a first connection point and a second connection point; and a second driven part connectable to the second hub locker, the second driven part being pivotally mounted relative to the housing at a second pivot point and including a first connection point and a second connection point;

wherein, connection of the first connection points of the second driving part and the second driven part causes the second driven part to pivot about the second pivot point in a first direction in response to movement of the second driving part towards the second driven part, and connection of the second connection points of the second driving part and the second driven part causes the second driven part to pivot about the second pivot point in a second direction, opposite to the first direction, in response to movement of the second driving part towards the second driven part.

In a second aspect, the present invention provides an electrically controllable lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a first driver associated with the first hub locker; and a second driver associated with the second hub locker, wherein only one of the first driver or the second driver is electrically controllable to respectively position the first hub locker or the second hub locker to thereby selectively prevent or allow movement of the lock bolt in response to torque being applied to the first hub from the first handle or to the second hub from the second handle.

In one arrangement, the first driver is electrically controllable to position the first hub locker to thereby selectively prevent or allow movement of the lock bolt in response to torque being applied to the first hub from the first handle and the second driver and the second hub locker are set permanently unlocked by being set as fail safe with the second driver unpowered. In another arrangement, the first driver is electrically controllable to position the first hub locker to thereby selectively prevent or allow movement of the lock bolt in response to torque being applied to the first hub from the first handle and the second driver and the second hub locker are set permanently locked by being set as fail secure with the second driver unpowered.

In yet another arrangement, the second driver is electrically controllable to position the second hub locker to thereby selectively prevent or allow movement of the lock bolt in response to torque being applied to the second hub from the second handle and the first driver and the first hub locker are set permanently unlocked by being set as fail safe with the first driver unpowered. In a yet further arrangement, the second driver is electrically controllable to position the second hub locker to thereby selectively prevent or allow movement of the lock bolt in response to torque being applied to the second hub from the second handle and the first driver and the first hub locker are set permanently locked by being set as fail secure with the first driver unpowered.

The first hub locker is preferably positionable at an advanced position, preventing movement of the lock bolt in response to torque being applied to the first hub from the first handle, or a withdrawn position, allowing movement of the lock bolt in response to torque being applied to the first hub from the first handle.

The second hub locker is preferably positionable at an advanced position, preventing movement of the lock bolt in response to torque being applied to the second hub from the second handle, or a withdrawn position, allowing movement of the lock bolt in response to torque being applied to the second hub from the second handle.

The first driver and the second driver are preferably both biased in a direction opposite to their driven direction. More preferably, first driver and the second driver are biased by a spring, an elastic band, gravity, a motor, a solenoid, a magnetic force, an electromagnetic force, an electrostatic force or any other force supplying or storage means.

The first hub locker and the first driver are preferably settable as either fail safe or fail secure and the second hub locker and the second driver are preferably settable as either fail safe or fail secure, wherein the fail setting of the first hub locker and the first driver and the fail setting of the second hub locker and the second driver are independent of one another.

The first and second drivers are preferably in the form of a solenoid, a motor, a gravity driven device, a spring, an elastic band, an electromagnetic force, an electrostatic force or any other force supplying or storage means.

The first driver is preferably an electrically powered pull type solenoid with a spring biased return. The second driver is preferably an electrically powered pull type solenoid with a spring biased return.

Alternatively, the first driver is an electrically powered push type solenoid with a spring biased return. The second driver is preferably an electrically powered push type solenoid with a spring biased return.

Further alternatively, the first driver is an electrically powered pull type solenoid with a spring biased return. Alternatively, the second driver is preferably an electrically powered push type solenoid with a spring biased return.

Yet further alternatively, the first driver is an electrically powered push type solenoid with a spring biased return. Alternatively, the second driver is preferably an electrically powered pull type solenoid with a spring biased return.

The lock assembly preferably includes:

a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second driver causes the second hub locker to move in a first direction, or a second position in which energising of the second driver causes the second hub locker to move in a second direction, opposite to the first direction.

The first motion transfer means preferably includes:

a first driving part connectable to the first driver, the first driving part includes a first connection point and a second connection point; and a first driven part connectable to the first hub locker, the first driven part being pivotally mounted relative to the housing at a first pivot point and including a first connection point and a second connection point;

wherein, connection of the first connection points of the first driving part and the first driven part causes the first driven part to pivot about the first pivot point in a first direction in response to movement of the first driving part towards the first driven part, and connection of the second connection points of the first driving part and the first driven part causes the first driven part to pivot about the first pivot point in a second direction, opposite to the first direction, in response to movement of the first driving part towards the first driven part.

The second motion transfer means preferably includes:

a second driving part connectable to the second driver, the second driving part includes a first connection point and a second connection point; and a second driven part connectable to the second hub locker, the second driven part being pivotally mounted relative to the housing at a second pivot point and including a first connection point and a second connection point;

wherein, connection of the first connection points of the second driving part and the second driven part causes the second driven part to pivot about the second pivot point in a first direction in response to movement of the second driving part towards the second driven part, and connection of the second connection points of the second driving part and the second driven part causes the second driven part to pivot about the second pivot point in a second direction, opposite to the first direction, in response to movement of the second driving part towards the second driven part.

In a third aspect, the present invention provides an electrically controllable lock assembly, the lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a driver associated with the first hub locker and the second hub locker;

a first motion transfer means between the driver and the first hub locker, the first motion transfer means being settable so the first hub locker is either fail safe or fail secure; and a second motion transfer means between the driver and the second hub locker, the second motion transfer means being settable so the second hub locker is either fail safe or fail secure, wherein the driver is electrically controllable to position the first hub locker to selectively prevent or allow movement of the lock bolt in response to torque being applied to the first hub from the first handle and to position the second hub locker to selectively prevent or allow movement of the lock bolt in response to torque being applied to the second hub from the second handle.

In one arrangement, the driver is electrically controllable to allow movement of the lock bolt in response to torque being applied to the first hub from the first handle and allow movement of the lock bolt in response to torque being applied to the second hub from the second handle. In another arrangement, the driver is electrically controllable to allow movement of the lock bolt in response to torque being applied to the first hub from the first handle and prevent movement of the lock bolt in response to torque being applied to the second hub from the second handle. In yet another arrangement, the driver is electrically controllable to prevent movement of the lock bolt in response to torque being applied to the first hub from the first handle and allow movement of the lock bolt in response to torque being applied to the second hub from the second handle. In a yet further arrangement, the driver is electrically controllable to prevent movement of the lock bolt in response to torque being applied to the first hub from the first handle and prevent movement of the lock bolt in response to torque being applied to the second hub from the second handle.

Preferably, the first motion transfer means is settable in a first position, in which energising of the driver causes the first hub locker to move in a first direction, or a second position, in which energising of the driver causes the first hub locker to move in a second direction, opposite to the first direction; and the second motion transfer means is settable in a first position, in which energising of the driver causes the second hub locker to move in a first direction, or a second position in which energising of the driver causes the second hub locker to move in a second direction, opposite to the first direction.

The first hub locker is preferably positionable at an advanced position, preventing movement of the lock bolt in response to torque being applied to the first hub from the first handle, or a withdrawn position, allowing movement of the lock bolt in response to torque being applied to the first hub from the first handle.

The second hub locker is preferably positionable at an advanced position, preventing movement of the lock bolt in response to torque being applied to the second hub from the second handle, or a withdrawn position, allowing movement of the lock bolt in response to torque being applied to the second hub from the second handle.

The driver is preferably biased in a direction opposite to its driven direction. More preferably, the driver is biased by a spring, an elastic band, gravity, a motor, a solenoid, a magnetic force, an electromagnetic force, an electrostatic force or any other force supplying or storage means.

The first hub locker and the driver are preferably settable as either fail safe or fail secure and the second hub locker and the driver are preferably settable as either fail safe or fail secure, wherein the fail setting of the first hub locker and the driver and the fail setting of the second hub locker and the driver are independent of one another.

The first hub locker and the driver are preferably set as fail secure and the second hub locker and the driver are preferably set as fail secure, whereby: the driver is energised to drive the first hub locker from the advanced position to the withdrawn position and the driver is energised to drive the second hub locker from advanced position to the withdrawn position; or the driver and the first hub locker are biased from the withdrawn position to the advanced position and the driver and the second hub locker are biased from the withdrawn position to the advanced position.

The first hub locker and the driver are preferably set as fail safe and the second hub locker and the driver are preferably set as fail secure, whereby:

the driver is energised to drive the first hub locker from the withdrawn position to the advanced position and the driver is energised to drive the second hub locker from advanced position to the withdrawn position; or the driver and the first hub locker are biased from the advanced position to the withdrawn position and the driver and the second hub locker are biased from the withdrawn position to the advanced position.

The first hub locker and the driver are preferably set as fail secure and the second hub locker and the driver are preferably set as fail safe, whereby:

the driver is energised to drive the first hub locker from the advanced position to the withdrawn position and the driver is energised to drive the second hub locker from the withdrawn position to the advanced position; or the driver and the first hub locker are biased from the withdrawn position to the advanced position and the driver and the second hub locker are biased from the advanced position to the withdrawn position.

The first hub locker and the driver are preferably set as fail safe and the second hub locker and the driver are preferably set as fail safe, whereby:

the driver is energised to drive the first hub locker from the withdrawn position to the advanced position and the driver is energised to drive the second hub locker from withdrawn position to the advanced position; or the driver and the first hub locker are biased from the advanced position to the withdrawn position and the driver and the second hub locker are biased from the advanced position to the withdrawn position.

The driver is preferably in the form of a solenoid, a motor, a gravity driven device, a spring, an elastic band, a magnetic force, an electromagnetic force, an electrostatic force or any other force supplying or storage means.

The driver is preferably an electrically powered pull type solenoid with a spring biased return. Alternatively, the driver is an electrically powered push type solenoid with a spring biased return.

The first motion transfer means preferably includes:

a first driving part releasably connectable to the driver, the first driving part includes a first connection point and a second connection point; and a first driven part connectable to the first hub locker, the first driven part being pivotally mounted relative to the housing at a first pivot point and including a first connection point and a second connection point;

wherein, connection of the first connection points of the first driving part and the first driven part causes the first driven part to pivot about the first pivot point in a first direction in response to movement of the first driving part towards the first driven part, and connection of the second connection points of the first driving part and the first driven part causes the first driven part to pivot about the first pivot point in a second direction, opposite to the first direction, in response to movement of the first driving part towards the first driven part.

The second motion transfer means preferably includes:

a second driving part releasably connectable to the driver, the second driving part includes a first connection point and a second connection point; and a second driven part connectable to the second hub locker, the second driven part being pivotally mounted relative to the housing at a second pivot point and including a first connection point and a second connection point;

wherein, connection of the first connection points of the second driving part and the second driven part causes the second driven part to pivot about the second pivot point in a first direction in response to movement of the second driving part towards the second driven part, and connection of the second connection points of the second driving part and the second driven part causes the second driven part to pivot about the second pivot point in a second direction, opposite to the first direction, in response to movement of the second driving part towards the second driven part.

In one arrangement, the driver is electrically controllable to position the first hub locker to thereby selectively prevent or allow movement of the lock bolt in response to torque being applied to the first hub from the first handle and the second hub locker and second motion transfer means are set permanently fail safe and disconnected from the driver. In another arrangement, the driver is electrically controllable to position the first hub locker to thereby selectively prevent or allow movement of the lock bolt in response to torque being applied to the first hub from the first handle and the second hub locker and second motion transfer means are set permanently fail secure and disconnected from the driver.

In yet another arrangement, the driver is electrically controllable to position the second hub locker to thereby selectively prevent or allow movement of the lock bolt in response to torque being applied to the second hub from the second handle and the first hub locker and first motion transfer means are set permanently fail safe and disconnected from the driver. In a yet further arrangement, the driver is electrically controllable to position the second hub locker to thereby selectively prevent or allow movement of the lock bolt in response to torque being applied to the second hub from the second handle and the first hub locker and first motion transfer means are set permanently fail secure and disconnected from the driver.

In a fourth aspect, the present invention provides a lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle; and a second hub locker positionable to selectively prevent or allow movement of the lock bolt in response to torque being applied to the second hub from the second handle, wherein the first hub locker and the second hub locker are positionable independently of one another.

The lock assembly preferably includes a first driver electrically controllable to position the first hub locker to thereby selectively prevent or allow movement of the lock bolt in response to torque being applied to the first hub from the first handle and a second driver electrically controllable to position the second hub locker to thereby selectively prevent or allow movement of the lock bolt in response to torque being applied to the second hub from the second handle.

The first driver and the second driver are preferably electrically controllable independently of one another.

The first driver and the second driver are preferably controllable independently of one another in response to respective first and second power signals each associated with respective first and second control signals. In this embodiment, the lock assembly is suitable for connection to a 2 control wire loom with the first and second control signals being provided by respective first and second wires.

The first driver and the second driver are preferably electrically controllable in tandem with one another.

The first driver and the second driver are preferably controllable in tandem with one another in response to respective first and second power signals both associated with a single control signal. In this embodiment, the lock assembly is suitable for connection to a 1 control wire loom with the single control signal being provided by a single wire.

The lock assembly is preferably reconfigurable between the first driver and the second driver being electrically controllable independently of one another and the first driver and the second drifer being electrically controllable in tandem with one another.

In a preferred form, the lock assembly includes a housing and the first driver and the second driver are both positioned within the housing. In one alternate form, the lock assembly includes a first escutcheon on one side of the housing and a second escutcheon of the other side of the housing and one of the first driver or the second driver are positioned within the housing and the other of the first driver or the second driver are positioned external the housing and within one of the first or the second escutcheons. In another alternate form, the lock assembly includes a first escutcheon on one side of the housing and a second escutcheon of the other side of the housing and the first driver is positioned external the housing and within the first escutcheon and the second driver is positioned external the housing and within the second escutcheon.

In one form, the lock assembly is preferably adapted to energise the first and second drivers in response to first and second control signals respectively.

In another form, the lock assembly preferably includes a switch arrangement adapted to enable or disable the energising of the first driver and/or the second driver in response to first and/or second control signals respectively. The switch arrangement is preferably on the exterior of the housing, most preferably on a surface adjacent the latch beneath a face plate.

In a yet further form, the switch arrangement is adapted to allow: first and second control signals applied to first and second control wires to be communicated to the first and second drivers respectively; or the first and second control signals applied to the first and second control wires to be communicated to the second and first drivers respectively.

The first hub locker is preferably positionable at an advanced position, preventing movement of the lock bolt in response to torque being applied to the first hub from the first handle, or a withdrawn position, allowing movement of the lock bolt in response to torque being applied to the first hub from the first handle.

The second hub locker is preferably positionable at an advanced position, preventing movement of the lock bolt in response to torque being applied to the second hub from the second handle, or a withdrawn position, allowing movement of the lock bolt in response to torque being applied to the second hub from the second handle.

The first driver and the second driver are preferably both biased in a direction opposite to their driven direction. More preferably, first driver and the second driver are biased by a spring, an elastic band, gravity, a motor, a solenoid, a magnetic force, an electromagnetic force, an electrostatic force, or any other force supplying or storage means.

The first hub locker and the first driver are preferably settable as either fail safe—or fail secure and the second hub locker and the second driver are preferably settable as either fail safe or fail secure, wherein the fail setting of the first hub locker and the first driver and the fail setting of the second hub locker and the second driver are independent of one another.

The first hub locker and the first driver are preferably set as fail secure and the second hub locker and the second driver are preferably set as fail secure, whereby:

the first driver is energised to drive the first hub locker from the advanced position to the withdrawn position and the second driver is energised to drive the second hub locker from advanced position to the withdrawn position; or the first driver and the first hub locker are biased from the withdrawn position to the advanced position and the second driver and the second hub locker are biased from the withdrawn position to the advanced position.

The first hub locker and the first driver are preferably set as fail safe and the second hub locker and the second driver are preferably set as fail secure, whereby:

the first driver energised to drive the first hub locker from the withdrawn position to the advanced position and the second driver is energised to drive the second hub locker from advanced position to the withdrawn position; or the first driver and the first hub locker are biased from the advanced position to the withdrawn position and the second driver and the second hub locker are biased from the withdrawn position to the advanced position.

The first hub locker and the first driver are preferably set as fail secure and the second hub locker and the second driver are preferably set as fail safe, whereby:

the first driver is energised to drive the first hub locker from the advanced position to the withdrawn position and the second driver is energised to drive the second hub locker from the withdrawn position to the advanced position; or the first driver and the first hub locker are biased from the withdrawn position to the advanced position and the second driver and the second hub locker are biased from the advanced position to the withdrawn position.

The first hub locker and the first driver are preferably set as fail safe and the second hub locker and the second driver are preferably set as fail safe, whereby:

the first driver is energised to drive the first hub locker from the withdrawn position to the advanced position and the second driver is energised to drive the second hub locker from withdrawn position to the advanced position; or the first driver and the first hub locker are biased from the advanced position to the withdrawn position and the second driver and the second hub locker are biased from the advanced position to the withdrawn position.

The first and second drivers are preferably in the form of a solenoid, a motor, a gravity driven device, a spring, an elastic band, a magnetic force, an electromagnetic force, an electrostatic force or any other force supplying or storage means.

The first driver is preferably an electrically powered pull type solenoid with a spring biased return. The second driver is preferably an electrically powered pull type solenoid with a spring biased return.

Alternatively, the first driver is an electrically powered push type solenoid with a spring biased return. The second driver is preferably an electrically powered push type solenoid with a spring biased return.

Further alternatively, the first driver is an electrically powered pull type solenoid with a spring biased return. Alternatively, the second driver is preferably an electrically powered push type solenoid with a spring biased return.

Yet further alternatively, the first driver is an electrically powered push type solenoid with a spring biased return. Alternatively, the second driver is preferably an electrically powered pull type solenoid with a spring biased return.

The lock assembly preferably includes:

a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second causes the second hub locker to move in a first direction, or a second position in which energising of the second driver causes the second hub locker to move in a second direction, opposite to the first direction.

The first motion transfer means preferably includes:

a first driving part connectable to the first driver, the first driving part includes a first connection point and a second connection point; and a first driven part connectable to the first hub locker, the first driven part being pivotally mounted relative to the housing at a first pivot point and including a first connection point and a second connection point;

wherein, connection of the first connection points of the first driving part and the first driven part causes the first driven part to pivot about the first pivot point in a first direction in response to movement of the first driving part towards the first driven part, and connection of the second connection points of the first driving part and the first driven part causes the first driven part to pivot about the first pivot point in a second direction, opposite to the first direction, in response to movement of the first driving part towards the first driven part.

The second motion transfer means preferably includes:

a second driving part connectable to the second driver, the second driving part includes a first connection point and a second connection point; and a second driven part connectable to the second hub locker, the second driven part being pivotally mounted relative to the housing at a second pivot point and including a first connection point and a second connection point;

wherein, connection of the first connection points of the second driving part and the second driven part causes the second driven part to pivot about the second pivot point in a first direction in response to movement of the second driving part towards the second driven part, and connection of the second connection points of the second driving part and the second driven part causes the second driven part to pivot about the second pivot point in a second direction, opposite to the first direction, in response to movement of the second driving part towards the second driven part.

The lock assembly preferably includes:

a driver associated with the first hub locker and the second hub locker;

a first motion transfer means between the driver and the first hub locker, the first motion transfer means being settable so the first hub locker is either fail safe or fail secure; and a second motion transfer means between the driver and the second hub locker, the second motion transfer means being settable so the second hub locker is either fail safe or fail secure, wherein the driver is electrically controllable to position the first hub locker to selectively prevent or allow movement of the lock bolt in response to torque being applied to the first hub from the first handle and to position the second hub locker to selectively prevent or allow movement of the lock bolt in response to torque being applied to the second hub from the second handle.

In one arrangement, the driver is electrically controllable to allow movement of the lock bolt in response to torque being applied to the first hub from the first handle and allow movement of the lock bolt in response to torque being applied to the second hub from the second handle. In another arrangement, the driver is electrically controllable to allow movement of the lock bolt in response to torque being applied to the first hub from the first handle and prevent movement of the lock bolt in response to torque being applied to the second hub from the second handle. In yet another arrangement, the driver is electrically controllable to prevent movement of the lock bolt in response to torque being applied to the first hub from the first handle and allow movement of the lock bolt in response to torque being applied to the second hub from the second handle. In a yet further arrangement, the driver is electrically controllable to prevent movement of the lock bolt in response to torque being applied to the first hub from the first handle and prevent movement of the lock bolt in response to torque being applied to the second hub from the second handle.

Preferably, the first motion transfer means is settable in a first position, in which energising of the driver causes the first hub locker to move in a first direction, or a second position, in which energising of the driver causes the first hub locker to move in a second direction, opposite to the first direction; and the second motion transfer means is settable in a first position, in which energising of the driver causes the second hub locker to move in a first direction, or a second position in which energising of the driver causes the second hub locker to move in a second direction, opposite to the first direction.

The first hub locker is preferably positionable at an advanced position, preventing movement of the lock bolt in response to torque being applied to the first hub from the first handle, or a withdrawn position, allowing movement of the lock bolt in response to torque being applied to the first hub from the first handle.

The second hub locker is preferably positionable at an advanced position, preventing movement of the lock bolt in response to torque being applied to the second hub from the second handle, or a withdrawn position, allowing movement of the lock bolt in response to torque being applied to the second hub from the second handle.

The driver is preferably biased in a direction opposite to its driven direction. More preferably, the driver is biased by a spring, an elastic band, gravity, a motor, a solenoid, a magnetic force, an electromagnetic force, an electrostatic force or any other force supplying or storage means.

The first hub locker and the driver are preferably settable as either fail safe or fail secure and the second hub locker and the driver are preferably settable as either fail safe or fail secure, wherein the fail setting of the first hub locker and the driver and the fail setting of the second hub locker and the driver are independent of one another.

The first hub locker and the driver are preferably set as fail secure and the second hub locker and the driver are preferably set as fail secure, whereby:

the driver is energised to drive the first hub locker from the advanced position to the withdrawn position and the driver is energised to drive the second hub locker from advanced position to the withdrawn position; or the driver and the first hub locker are biased from the withdrawn position to the advanced position and the driver and the second hub locker are biased from the withdrawn position to the advanced position.

The first hub locker and the driver are preferably set as fail safe and the second hub locker and the driver are preferably set as fail secure, whereby:

the driver is energised to drive the first hub locker from the withdrawn position to the advanced position and the driver is energised to drive the second hub locker from advanced position to the withdrawn position; or the driver and the first hub locker are biased from the advanced position to the withdrawn position and the driver and the second hub locker are biased from the withdrawn position to the advanced position.

The first hub locker and the driver are preferably set as fail secure and the second hub locker and the driver are preferably set as fail safe, whereby:

the driver is energised to drive the first hub locker from the advanced position to the withdrawn position and the driver is energised to drive the second hub locker from the withdrawn position to the advanced position; or the driver and the first hub locker are biased from the withdrawn position to the advanced position and the driver and the second hub locker are biased from the advanced position to the withdrawn position.

The first hub locker and the driver are preferably set as fail safe and the second hub locker and the driver are preferably set as fail safe, whereby:

the driver is energised to drive the first hub locker from the withdrawn position to the advanced position and the driver is energised to drive the second hub locker from withdrawn position to the advanced position; or the driver and the first hub locker are biased from the advanced position to the withdrawn position and the driver and the second hub locker are biased from the advanced position to the withdrawn position.

The driver is preferably in the form of a solenoid, a motor, a gravity driven device, a spring, an elastic band, a magnetic force, an electromagnetic force, an electrostatic force or any other force supplying or storage means.

The driver is preferably an electrically powered pull type solenoid with a spring biased return. Alternatively, the driver is an electrically powered push type solenoid with a spring biased return.

The first motion transfer means preferably includes:

a first driving part releasably connectable to the driver, the first driving part includes a first connection point and a second connection point; and a first driven part connectable to the first hub locker, the first driven part being pivotally mounted relative to the housing at a first pivot point and including a first connection point and a second connection point;

wherein, connection of the first connection points of the first driving part and the first driven part causes the first driven part to pivot about the first pivot point in a first direction in response to movement of the first driving part towards the first driven part, and connection of the second connection points of the first driving part and the first driven part causes the first driven part to pivot about the first pivot point in a second direction, opposite to the first direction, in response to movement of the first driving part towards the first driven part.

The second motion transfer means preferably includes:

a second driving part releasably connectable to the driver, the second driving part includes a first connection point and a second connection point; and a second driven part connectable to the second hub locker, the second driven part being pivotally mounted relative to the housing at a second pivot point and including a first connection point and a second connection point;

wherein, connection of the first connection points of the second driving part and the second driven part causes the second driven part to pivot about the second pivot point in a first direction in response to movement of the second driving part towards the second driven part, and connection of the second connection points of the second driving part and the second driven part causes the second driven part to pivot about the second pivot point in a second direction, opposite to the first direction, in response to movement of the second driving part towards the second driven part.

In one arrangement, the driver is electrically controllable to position the first hub locker to thereby selectively prevent or allow movement of the lock bolt in response to torque being applied to the first hub from the first handle and the second hub locker and second motion transfer means are set permanently fail safe and disconnected from the driver. In another arrangement, the driver is electrically controllable to position the first hub locker to thereby selectively prevent or allow movement of the lock bolt in response to torque being applied to the first hub from the first handle and the second hub locker and second motion transfer means are set permanently fail secure and disconnected from the driver.

In yet another arrangement, the driver is electrically controllable to position the second hub locker to thereby selectively prevent or allow movement of the lock bolt in response to torque being applied to the second hub from the second handle and the first hub locker and first motion transfer means are set permanently fail safe and disconnected from the driver. In a yet further arrangement, the driver is electrically controllable to position the second hub locker to thereby selectively prevent or allow movement of the lock bolt in response to torque being applied to the second hub from the second handle and the first hub locker and first motion transfer means are set permanently fail secure and disconnected from the driver.

BRIEF DESCRIPTION OF THE DRAWINGS

Preferred embodiments will now be described, by way of examples only, with reference to the accompanying drawings, in which:

FIG. 16 is a summary table of functionality/flexibility for the lock assembly shown in FIG. 1;

FIG. 21 is a summary table of functionality/flexibility for the lock assembly shown in FIG. 19.

DETAILED DESCRIPTION OF THE PREFERRED EMBODIMENTS

Figure 1:
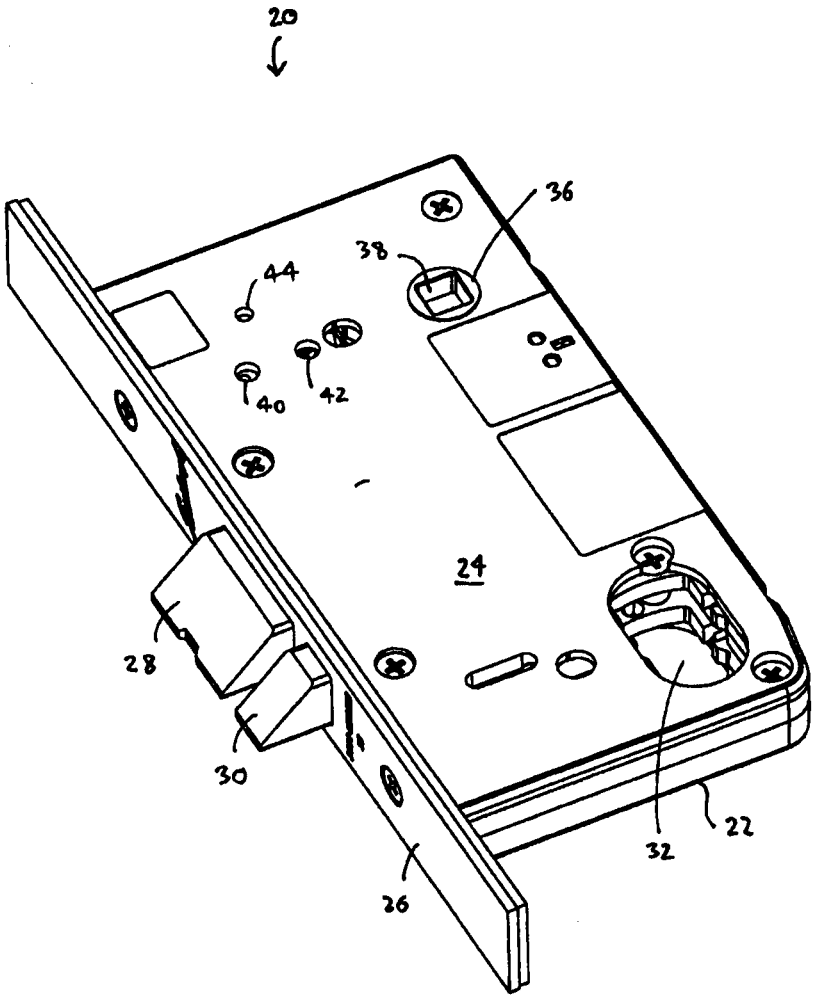
FIG. 1 is a right-hand side perspective view of a first embodiment of an electrically controllable lock assembly.

FIG. 1 shows a first embodiment of an electrically controllable lock assembly 20. The lock assembly 20 includes a housing 22 with a side cover 24 and a face plate 26. The lock assembly 20 is installed in a door with the face plate 26 adjacent to the non-hinged edge of the door, as is well understood by persons skilled in the art. A latch bolt 28 and an auxiliary bolt 30 pass through the face plate 26 for engagement with a strike plate (not shown) in a door jamb, as is also well understood by persons skilled in the art.

Figure 11:
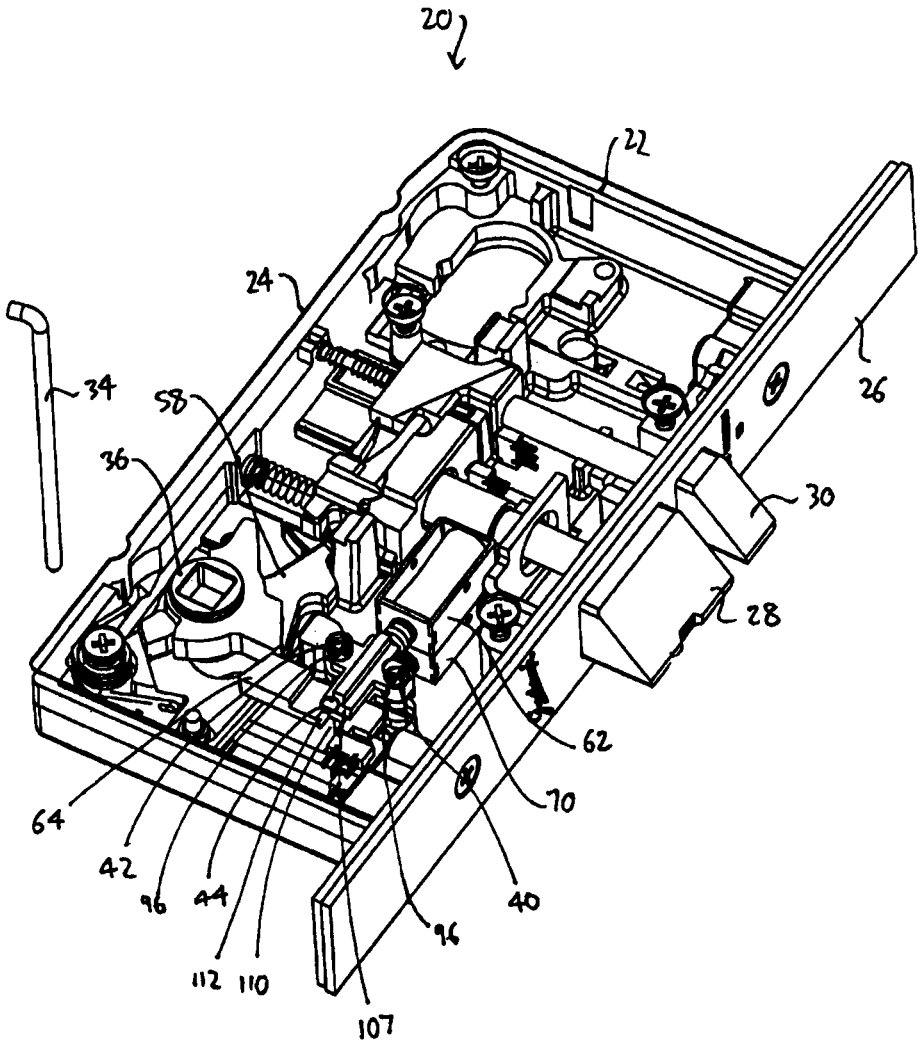
FIG. 11 is a perspective view of the lock assembly in FIG. 1 with transparent side cover.

The lock assembly 20 also includes an opening 32 that receives a key cylinder (not shown). The key cylinder is retained within the opening 32 with a key cylinder retaining pin 34 (see FIG. 11), as is also well understood by persons skilled in the art. After the key cylinder has been inserted into the opening 32, and the key cylinder retaining pin 34 inserted into the key cylinder, the key cylinder retaining pin 34 is prevented from releasing its engagement with the key cylinder by engagement of the face plate 26 with the housing 22. FIG. 11 shows the key cylinder retaining pin 34 removed from the lock assembly 20 and in a position ready for use in setting or resetting the fail safe/fail secure mechanisms of the lock assembly 20, which shall be described in more detail below.

The lock assembly 20 also includes a first hub 36 with a square cross-section opening 38 therein, which is adapted to engage with a square cross-section drive shaft (not shown) of a first external knob, lever or other handle (not shown).

The side cover 24 of the lock assembly 20 includes a first opening 40, a second opening 42 and a third opening 44, the functions of which shall be described in more detail below in relation to setting the fail safe/fail secure mechanisms. These holes are replicated on the opposite side of the housing 22 to that shown in FIG. 1.

Figure 2:
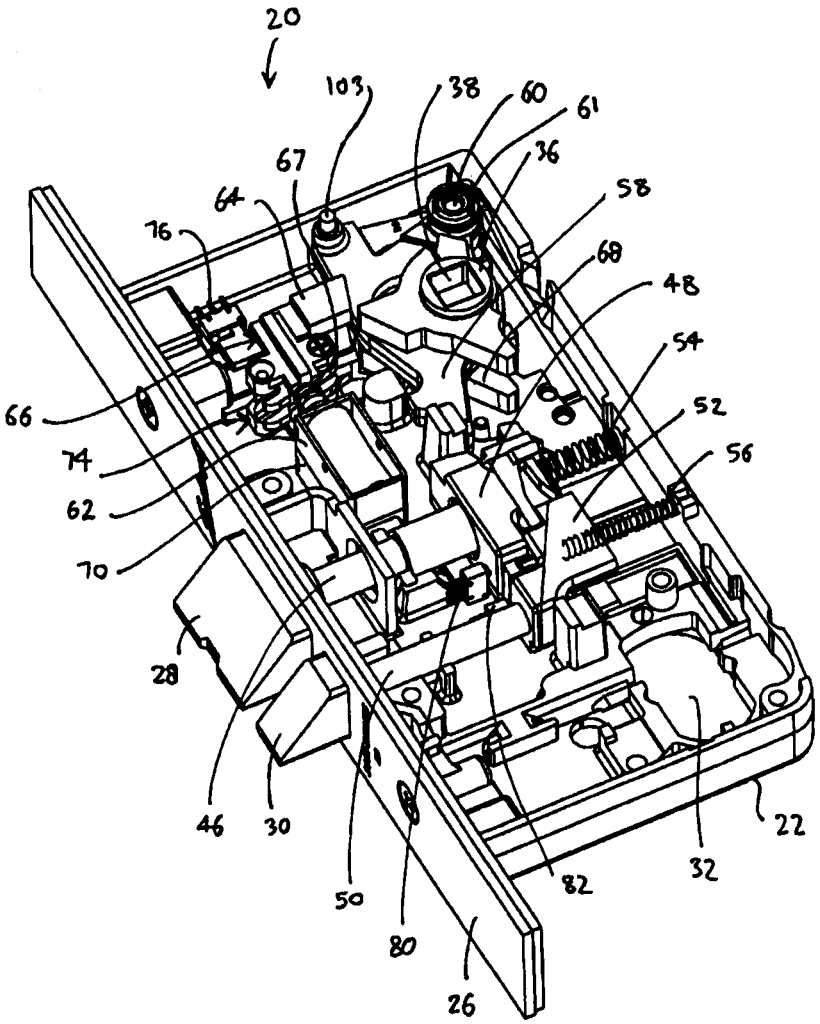
FIG. 2 is a right-hand side perspective view of the lock assembly shown in FIG. 1, with side cover removed.

FIG. 2 shows the lock assembly 20 with the side cover 24 of the housing 22 removed. The latch bolt 28 is connected to a latch bolt shaft 46 which is in turn connected to a latch bolt carriage 48. The auxiliary bolt 30 is connected to an auxiliary bolt shaft 50 which is in turn connected to an auxiliary bolt carriage 52. The latch bolt 28 and the auxiliary bolt 30 are biased towards the latching position shown in FIG. 2 by a latch spring 54 and an auxiliary latch spring 56.

A carriage retraction arm 58 is pivotally mounted to the housing 22 at shaft 60 and biased towards the position shown in FIG. 2 by a spring 61. The arm 58 can be moved to retract the latch bolt 28 and the auxiliary bolt 30 under certain conditions, in response to movement of the first or second handles or the key cylinder, as will be described in more detail below.

Figure 3:
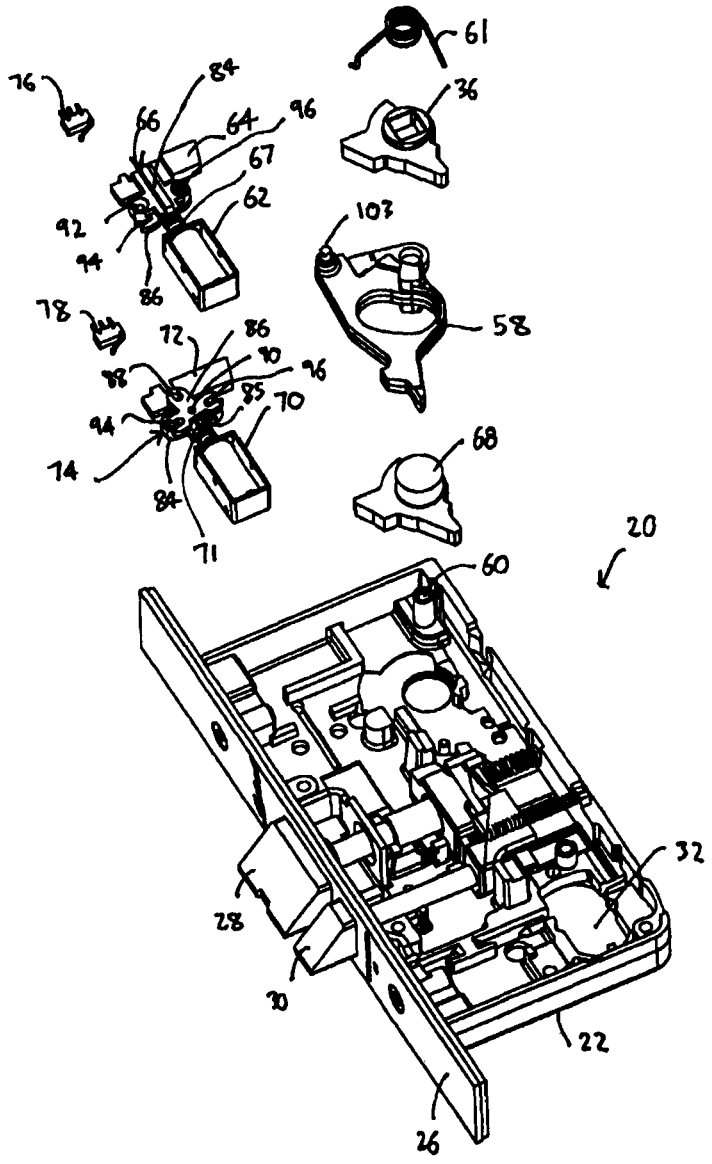
FIG. 3 is a partially exploded perspective view of the lock assembly shown in FIG. 2.

FIG. 2 also shows a first driver, in the form of a first electrically powered solenoid 62, which is connected to a first hub locker 64 (as best shown in FIGS. 2 and 3) by a first motion transfer means indicated generally with the reference numeral 66. The first solenoid 62 includes a first biasing spring 67 (as best shown in FIGS. 2 and 3). These components are replicated on the other side of the lock assembly 20 by: a second hub 68; a second driver in the form of a second electrically powered solenoid 70 including a second spring 71; a second hub locker 72 (best shown in FIG. 3); and a second motion transfer means indicated generally by the reference numeral 74.

FIG. 3 also shows a first hub locker sensor 76 and second hub locker sensor 78 which are able to provide a signal indicative of the position of the first and second hub lockers 64 and 72 respectively allow remote signalling of the lock status of the first and second hubs 36 and 68 to a controller or other internal control. FIGS. 2 and 3 also show a latch bolt sensor 80 and an auxiliary bolt sensor 82, which signal the position of the latch bolt 28 and the auxiliary bolt 30 respectively, to also allow remote signalling of the lock status or other internal control. Other sensors (not shown) can also be added as desired to other mechanical facets of the lock assembly 20 and/or to remotely signal lock and/or door status or to provide other internal control.

The construction and operation of the first and second motion transfer means 66 and 74 are identical. Turning to FIG. 3, the first and second motion transfer means 66 and 74 each include a driving part 84 connected to their associated solenoid via a (releasable) pin 85 and a driven part 86 connected to their associated hub locker via a pin 88. The driven parts 86, for each of the hub lockers, pivot relative to the housing 22 about respective pivot points in the form of openings 90. The openings 90 each engage with one of two pins extending from each side of a cross member (not shown) that is fixed relative to the housing 22 between the driven parts 86. The parts 84 and 86 also include a first connection point on one side of the pivot point 90 and a second connection point on the other side of the pivot point 90. The first and second connection points in the driving parts 84 are in the form of openings 92. The first and second connection points in the driven parts 86 are in the form of slots 94. A screw 96 may be placed through one of the openings 92 and extend into one of the slots 94 in order to connect the first connection points of the driving and driven parts 84 and 86 or the second connection points of the driving and driven parts 84 or 86. The selection of the first or second connection points allows the movement of the hub lockers 64 and 72 in response to the movement of their associated solenoids 62 and 70 to be independently configured in one of two opposite directions, as will be described in more detail below.

Figure 4:
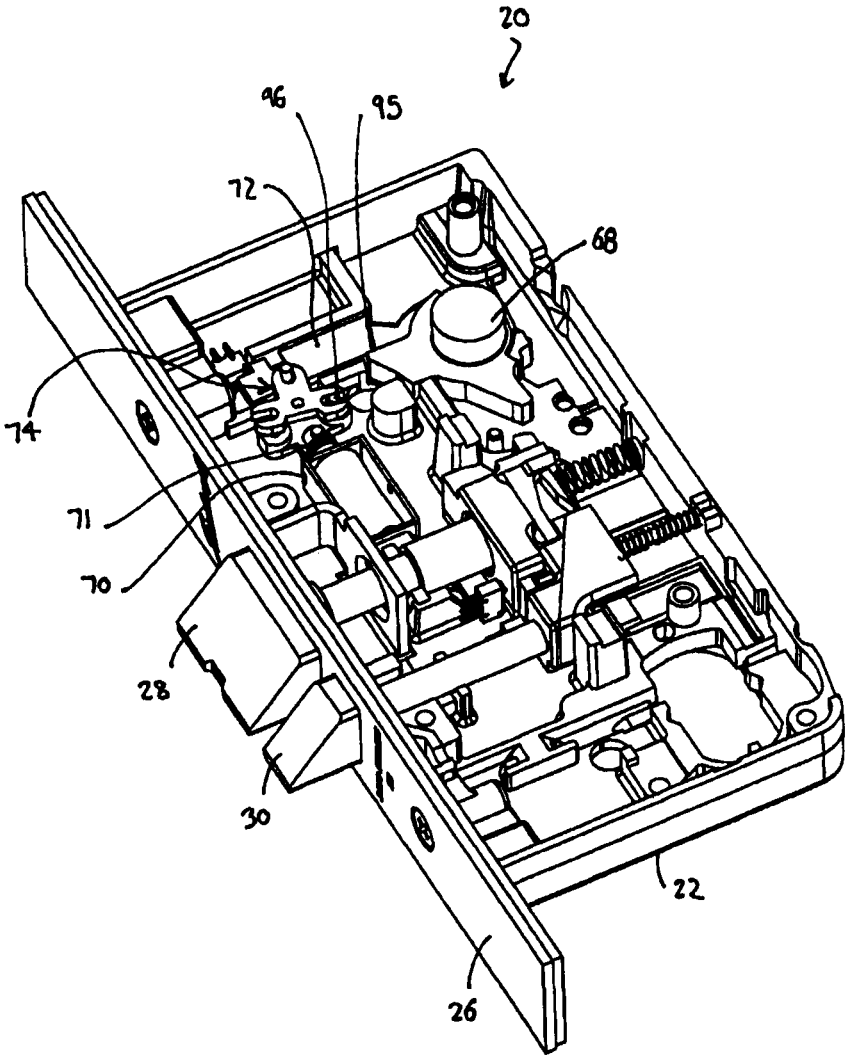
FIG. 4 is a partial perspective view of the lock assembly shown in FIG. 2 in fail safe setting with a hub locker advanced.

FIG. 4 shows the second solenoid 70, the second motion transfer means 74, the second hub locker 72 and the second hub 68 in the lock assembly 20 set in what is known as fail safe. More particularly, the second solenoid 70 is of the pull type which pulls the driving part 84 towards the second solenoid 70 when energised and then relies on the solenoid spring 71 to push the driving part 84 away from the second solenoid 70 when not energised. The second motion transfer means 74 is connected at the second connection point by the screw 96 which results in the second hub locker 72 also being driven, by the solenoid spring 71, away from the second hub 68, to a retracted position, when the associated solenoid is not energised and driven towards the hub 68, to an advanced position, when the solenoid is energised.

FIG. 4 shows the hub 68 side of lock assembly 20 whilst energy is applied to the second solenoid 70, drawing the driving part toward the second solenoid 70 and resulting in the motion transfer means 74 driving the hub locker 72 to the advanced position where it overlaps at 95 and abuts or engages with the hub 68. As a result, attempting to turn the handle (ie. applying torque to the handle and thus to the hub 68) associated with the hub 68 will not cause turning of the hub 68. The door is thus locked from the hub 68 side of the lock assembly 20.

Figure 5:
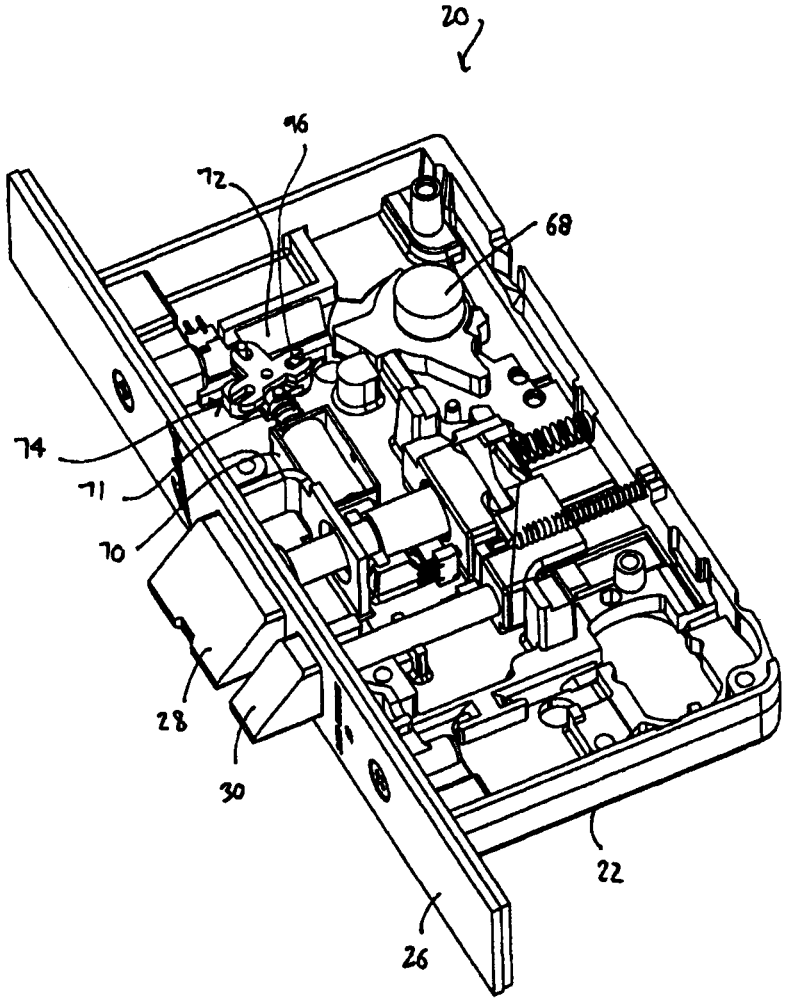
FIG. 5 is a perspective view of the lock assembly shown in FIG. 4 in fail safe setting with a hub locker withdrawn.

FIG. 5 shows the second solenoid 70, the second motion transfer means 74, the second hub locker 72 and the second hub 68 side of the lock assembly 20 in the same fail safe setting as FIG. 4, in the absence of energy being applied to the second solenoid 70. The solenoid spring 71 drives the hub locker 72 to the retracted position where it does not overlap, abut or engage with the hub 68. In this way, the hub 68 will turn in response to torque being applied to it by the turning of the associated handle, therefore allowing the bolts 28 and 30 to be retracted and the door to be unlatched in the absence of power to the solenoids (e.g. during a power failure). Accordingly, the door is unlocked from the hub 68 side of the lock assembly 20.

Figure 6:
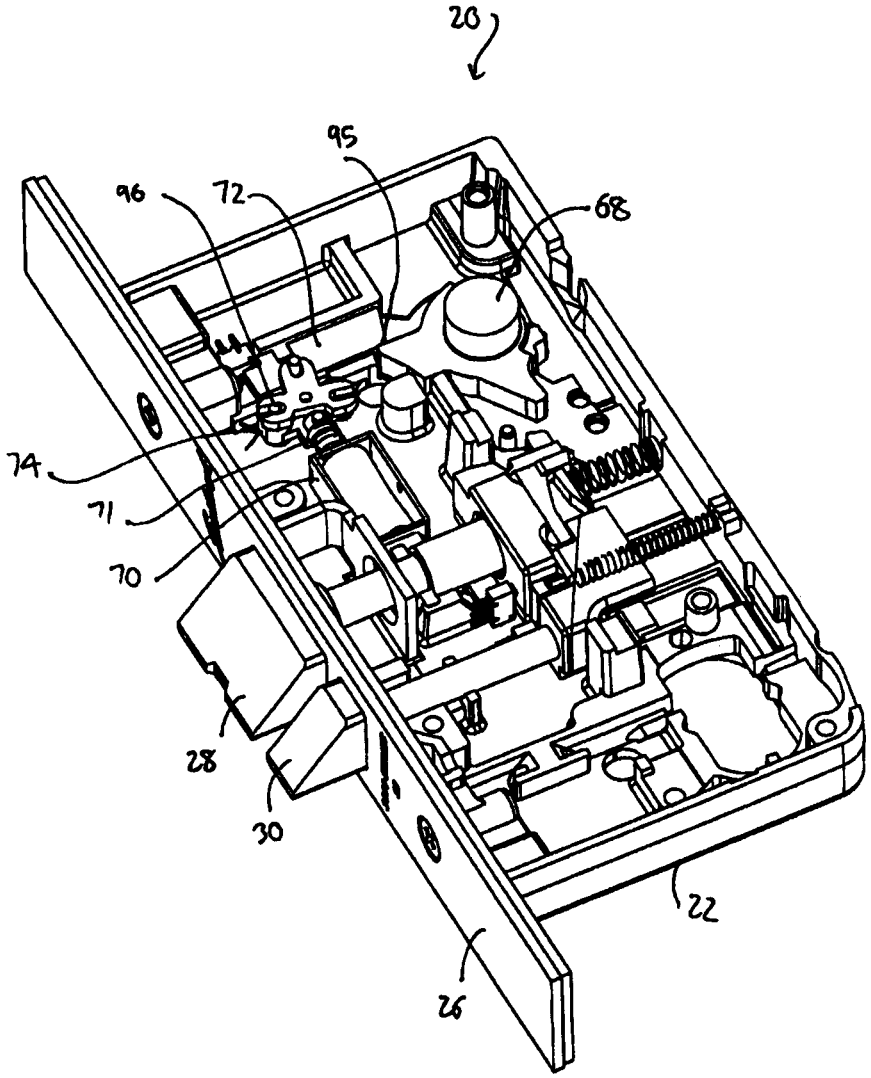
FIG. 6 is a partial perspective view of the lock assembly shown in FIG. 2 in fail secure setting with a hub locker advanced.
Figure 7:
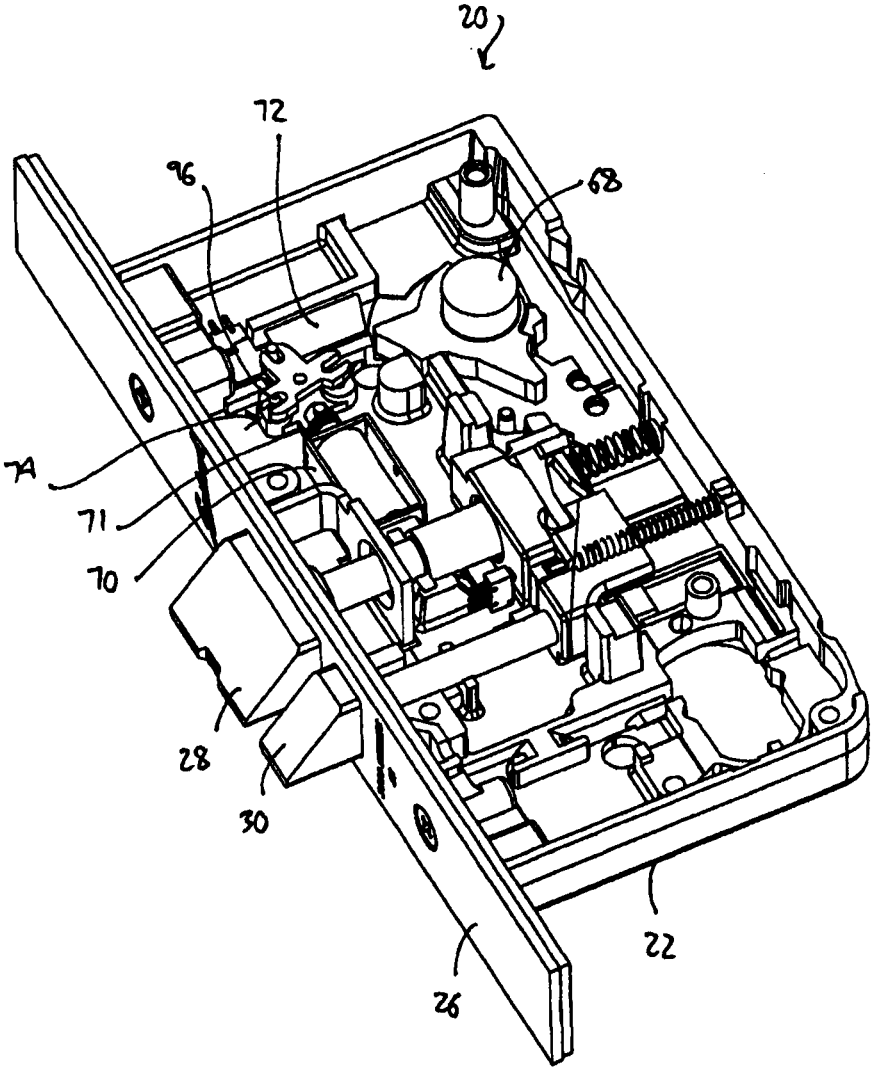
FIG. 7 is a perspective view of the lock assembly shown in FIG. 6 in fail secure setting with a hub locker withdrawn.

FIGS. 6 and 7 shows the second solenoid 70, the second motion transfer means 74, the second hub locker 72 and the second hub 68 side of the lock assembly 20 in a fail secure setting. In this setting, the driving part 84 and the driven part 86 of the second motion transfer means 74 are connected at the first connection point. As a result, in the absence of power, the hub locker 72 is driven by the solenoid spring 71 to the advanced position abutting at 95 thereby preventing rotation of the hub 68 in response to torque being applied to the hub 68 via attempted turning of its associated handle. As a result, the door is locked from the hub 68 side of the lock assembly 20 in the absence of power to the second solenoid 70.

FIG. 7 shows the second solenoid 70, the second motion transfer means 74, the second hub locker 72 and the second hub 68 side of the lock assembly 20 in the same fail secure setting as FIG. 5, with the solenoid 70 energised and retracted. This results in hub locker 72 being driven to the retracted position out of contact with the hub 68. As a result, the hub 68 will turn in response to torque being applied to the hub 68 by turning of its associated handle and the door is unlocked from the hub 68 side of the lock assembly 20.

Figure 8:
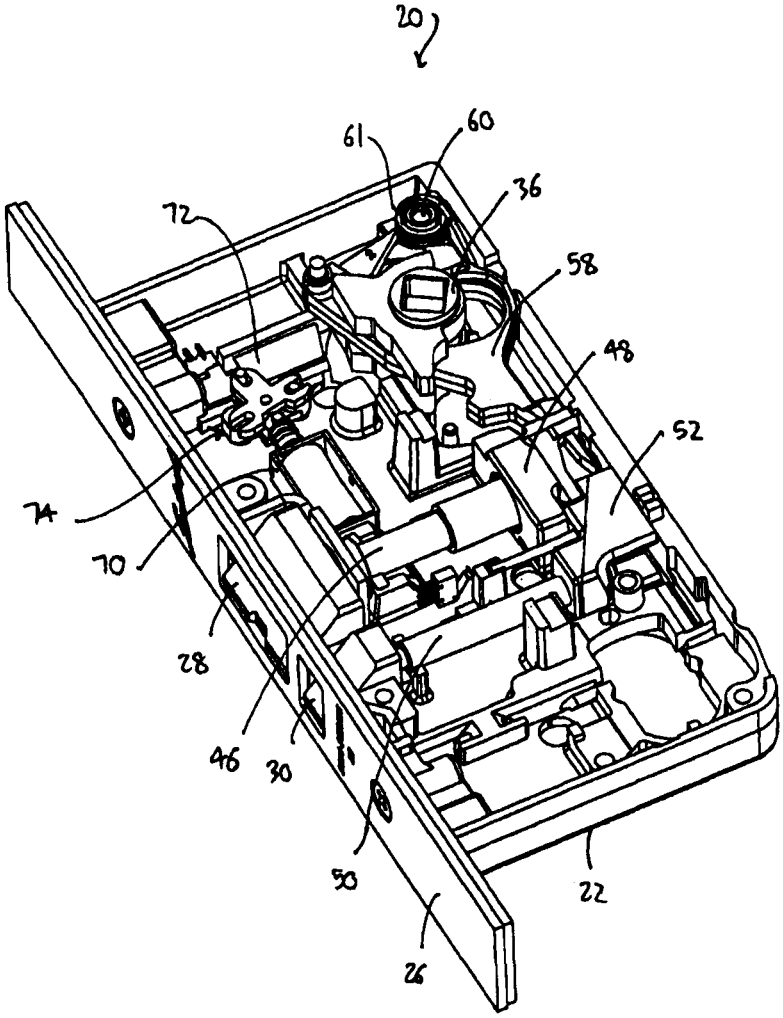
FIG. 8 is a perspective view of the lock assembly shown in FIG. 4 in fail safe configuration with a hub locker withdrawn and bolts retracted with hub components added.

FIG. 8 illustrates the movement of the latch bolt 28 and auxiliary bolt 30 to the unlatching position by the carriage retraction arm 58 in response to the hub 36 or 68 being rotated. It will be appreciated that the second solenoid 70, the second motion transfer means 74, the second hub locker 72 and the second hub 68 side of the lock assembly 20 is shown in the fail safe setting of FIG. 4 with power absent from the second solenoid 70, allowing the handle on the hub 68 side of the lock to rotate the hub 68.

The construction and operation of the like components associated with the other side of the lock assembly 20 (ie. the first hub 36, the first driver 62, the first motion transfer means 66 and the first hub locker 64) are the same of those described above.

Figure 9:
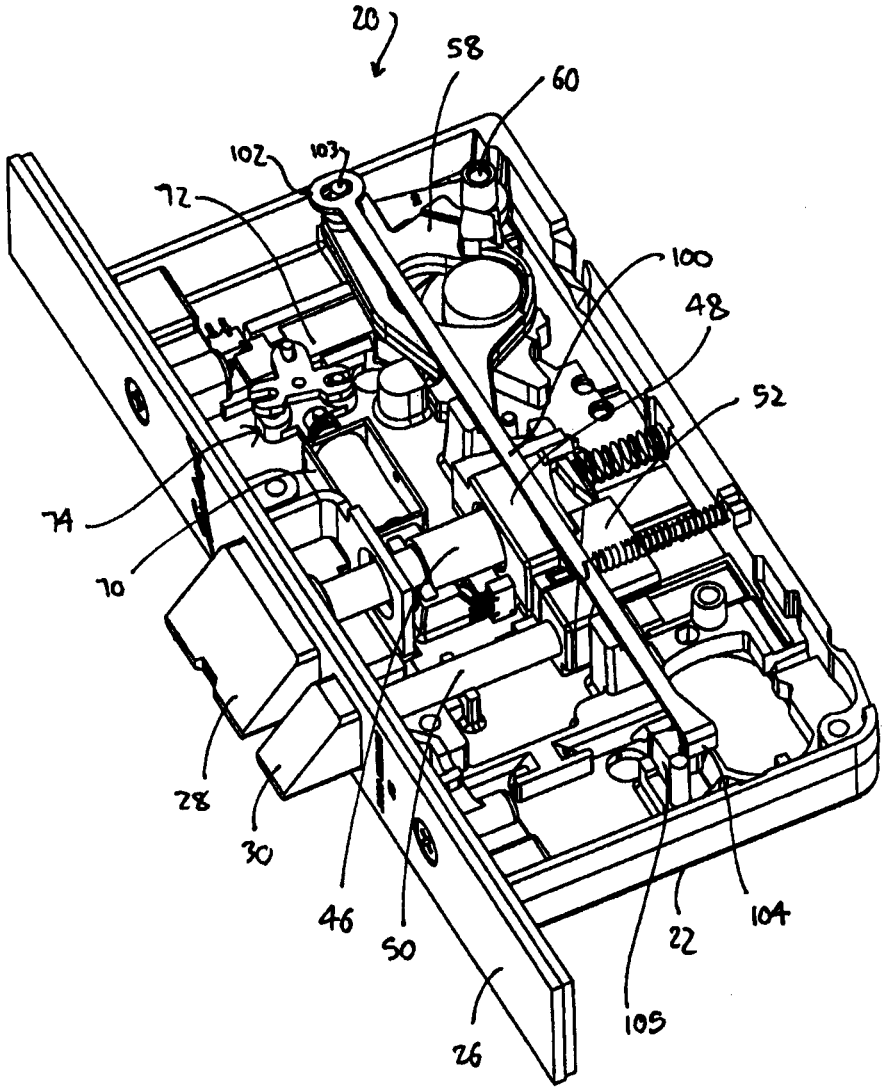
FIG. 9 is a partial perspective view of the lock assembly shown in FIG. 2 with components added for bolts retraction via key.
Figure 10:
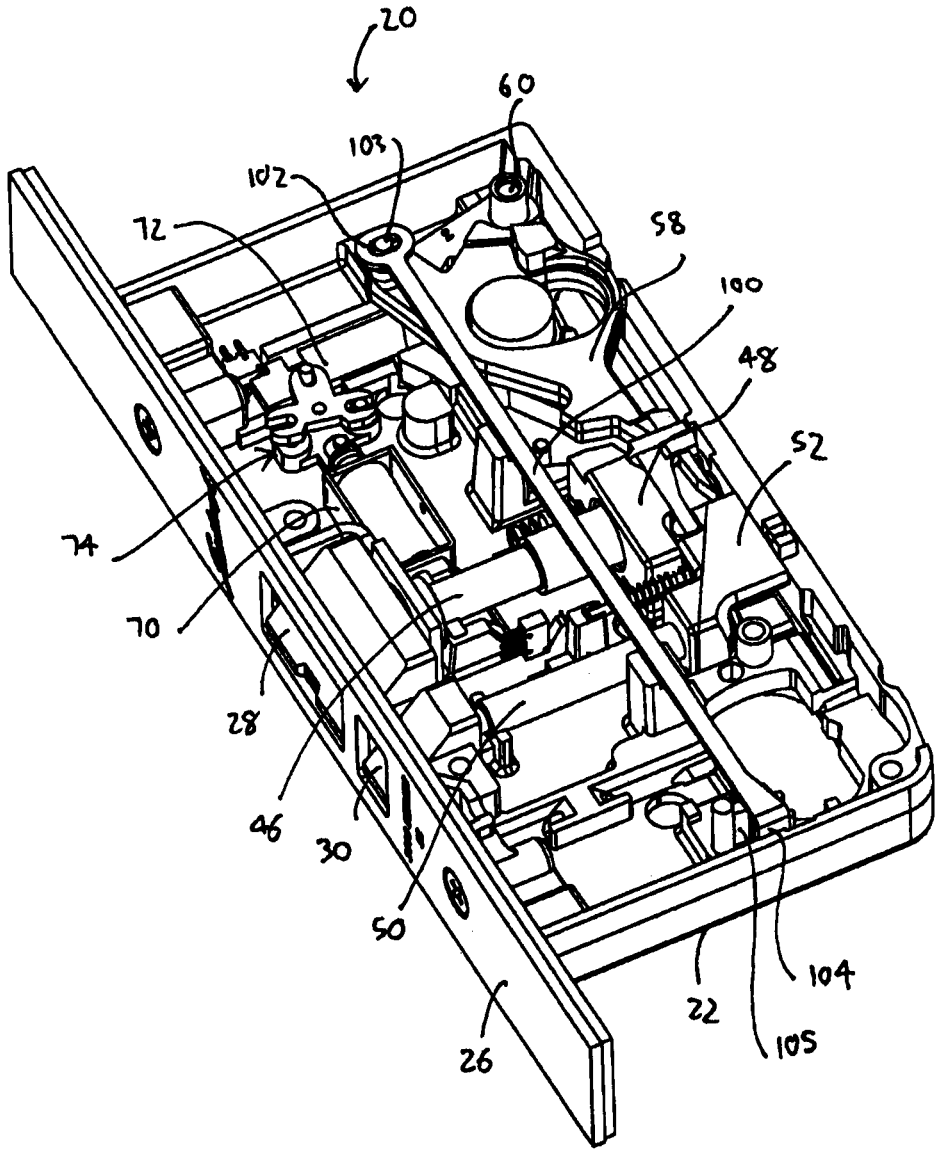
FIG. 10 is a perspective view of the lock assembly shown in FIG. 9 with bolts retracted via key.

The unlatching of the lock assembly 20 with a correct key will now be described with reference to FIGS. 9 and 10. FIG. 9 shows a key cylinder retraction bar 100. The bar 100 has one end 102 attached to the carriage retraction arm 58 at shaft 103 and a depending part 104 on the other end. This depending part 104 can be acted on by a driving gear 105. When a correct key is inserted into the key cylinder, the key cylinder can be rotated to cause a protuberance on the key cylinder to abut and rotate the driving gear 105. This then pulls on the depending part 104 of the bar 100 and moves it to the position shown in FIG. 10. As a result, the end 102 of the bar 100 causes the arm 58 to pivot around shaft 60 and retract the latch bolt 28 and the auxiliary bolt 30. In this way, the correct key can be used to unlatch a door that has otherwise been locked by energising of one or more of the solenoids when in fail safe mode or not energising one or more solenoids in fail secure mode.

The setting of the lock assembly 20 as fail safe or fail secure will now be described with reference to FIG. 11. In FIG. 11, the side cover 24 is shown translucent for the ease of description. The lock assembly 20 is supplied with two screws 96 inserted into both the first connection points and the second connection points of both of the first and the second motion transfer means 66 and 74. The desired one connection point giving either fail safe or fail secure operation can thus be selected by simply removing one of the screws 96 from the undesired connection point via one of the holes 40 or 42 (see FIG. 1).

A problem may exist if while the setting is being selected, the incorrect screw is removed so that the desired setting is not obtained. To help correct this problem, each of the hub lockers 64 and 72 include a slot 110 bounded by tapered surfaces 112 and the driving parts 84 have a tapered end face 107. As best seen in FIG. 11, when the pin 34 is inserted through the hole 44 it extends into the slot 110 to correctly position hub lockers 64 and 72 and also works against faces 107 of the driver parts 84 to correctly position them also. As a result, all of the connection points are aligned with each other and also with the screw access holes 40 and 42 so that the screws 96 may be re-fastened as desired and then pin 34 removed. The desired other screw 96 can then be removed to obtain the desired setting. This process can be undertaken from both sides of the lock assembly 20.

The electrically controlled lock assembly described above has numerous advantages over existing mechanical and electrically controllable locks. As mentioned previously, such locks can only be handed in one of the four handing function pairs at time of installation and the lock must be removed (or otherwise accessed) to be changed to another handing function pair. However, with the lock assembly described above, there is no preset handing operation of the locking control mechanism and so the lock is advantageously not limited to only providing one of four preset function pairs. Any state of locked or unlocked can be chosen for any side of the lock at any time. This provides vastly improved flexibility in relation to existing products.

For example, the lock assembly can advantageously be controlled to offer a user any individually selected locked or unlocked state on each side of the lock during normal office hours and any other individually selected locked or unlocked state on each side of the lock outside of those hours, without requiring any physical access to the lock assembly itself.

The lock assembly also advantageously allows the locked/unlocked state of one side of the lock to be altered independently of the other side of the lock. An example of where such independent changes are required is two hospital bedrooms each having access to a single shared bathroom. When no one is in the bathroom and both doors are closed, both doors are unlocked on the outside and locked on the inside, so that each room's occupant can enter the bathroom but can not enter into the other's bedroom. When a user enters the bathroom and closes their door, and locks the outside of it, the inside of that door must unlock so that they can get out again. In other words, the locked/unlocked state of the locks' sides are swapped. Simultaneously, it is desirable that the door to the other room gets locked on the outside, so that that room's occupant is prevented from entering the bathroom at the same time. The lock assembly allows these changes to happen as the inner and outer hub lockers can be moved independently of each other. Presently, these types of facilities are provided in buildings by combining, in the same door, an electric mortice lock with a separate electrical locking device such as an electromagnetic lock or an electric lock strike. However, these installations are complicated and expensive and require an extra lock mechanism and associated wiring, power and control mechanisms.

The lock assembly 20 advantageously also allows the initial setting as fail safe or fail secure to be quickly and easily made by the removal of a single screw from each side of the lock and, importantly, for each side of the lock to be set fail safe or fail secure independently of the other. This is in contrast to existing locks which do not permit one side of a lock to be set fail safe and the other side set as fail secure, as is summarised in FIG. 16.

As stated above, the lock assembly enables each of the inside and outside of the door to be selectively locked or unlocked at any time. A summary of the possible locked/unlocked states offered by the lock is provided in FIG. 16 together with an indication of the increased flexibility provided by same. For maximum flexibility, it is preferred to independently control each of the first and the second solenoids by utilising two control/power wires, one for each solenoid, and two circuits or pins within the connectors or wiring looms. Adding such a two wire loom from a controller to the lock assembly is not problematic when installing the lock assembly into new buildings.

It is preferable for lock manufacturers to not have to produce many different lock assemblies and, as mentioned above, it is preferable to manufacture the subject lock assembly with the first and second solenoids 62 and 70 that can each be independently operated for maximum flexibility.

However, the lock assembly may also be utilised with both of the solenoids controlled together (ie. in tandem) or only one of the two solenoids controlled. This enables the lock assembly to be fitted to buildings with an existing a one control/power wire loom, as may have been used to control an existing lock with a single solenoid. The control options afforded by such a one wire loom are also set out in FIG. 16. When the two wire and one wire functionality is considered together, this lock assembly has vastly improved flexibility over known arrangements.

The fitting of the lock assembly 20 to a one wire loom via three alternative wiring arrangements shall now be described with reference to FIGS. 12 to 15.

Figure 12:
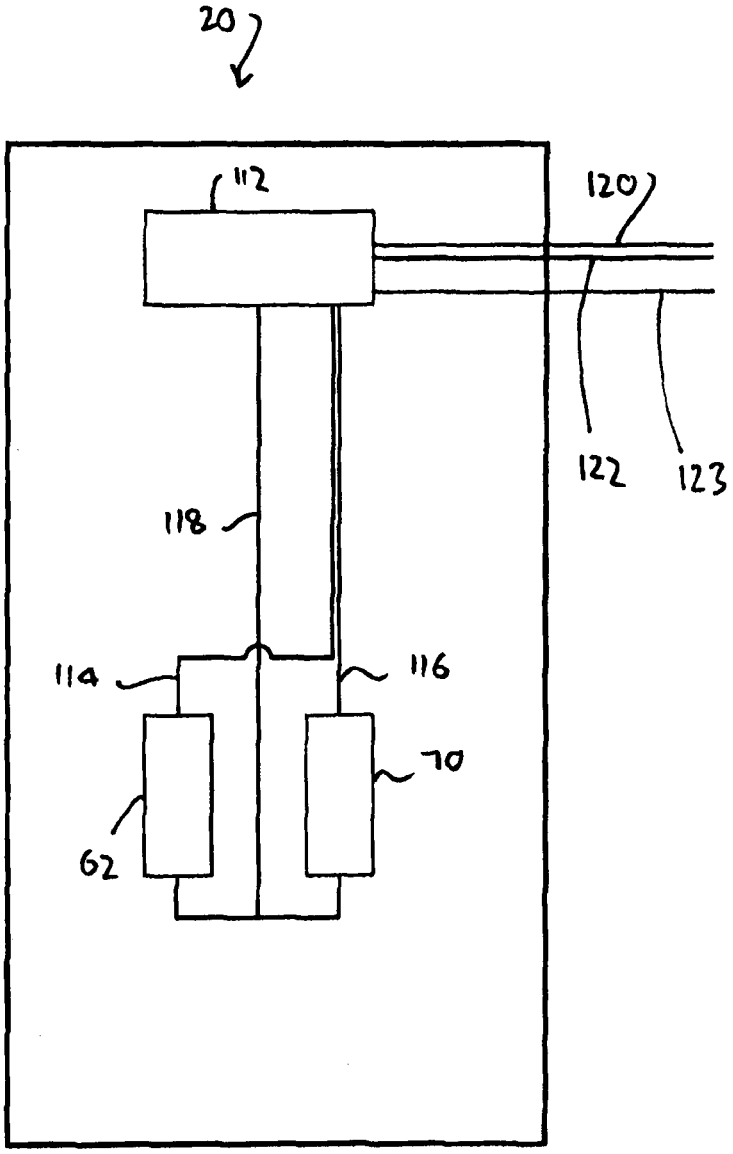
FIG. 12 is a schematic view of the wiring of the lock assembly shown in FIG. 1.

FIG. 12 shows that the lock assembly 20 includes a printed circuit board 112 for electronic components. The selection and operation of the electric components are well known to persons skilled in the art. As an example, the electric components are able to regulate the solenoid switching voltage to enable the first and second solenoids 62 and 70 to be operated with a variety of control/power system supply voltages. As another example, the electric components are able to allow an initial high power pull in voltage for the first and second solenoids 62 and 70 and then drop the power down to a minimal holding value to reduce the load on the external control/power system and also reduce heating of the first and second solenoids 62 and 70.

The first and second solenoids 62 and 70 are connected to the housing 112 by respective first and second power wires 114 and 116 and a common return wire 118. First and second lock control wires 120 and 122 and common/return/earth wire 123 connect the housing 112 to a building's control system.

Supplying a control signal to only the lock control wire 120 energises the first solenoid 62. Supplying a control signal to only the lock control wire 122 energises the second solenoid 70. Supplying control signals to both of the lock control wires 120 and 122 energises both the first solenoid 62 and the second solenoid 70.

Figure 13:
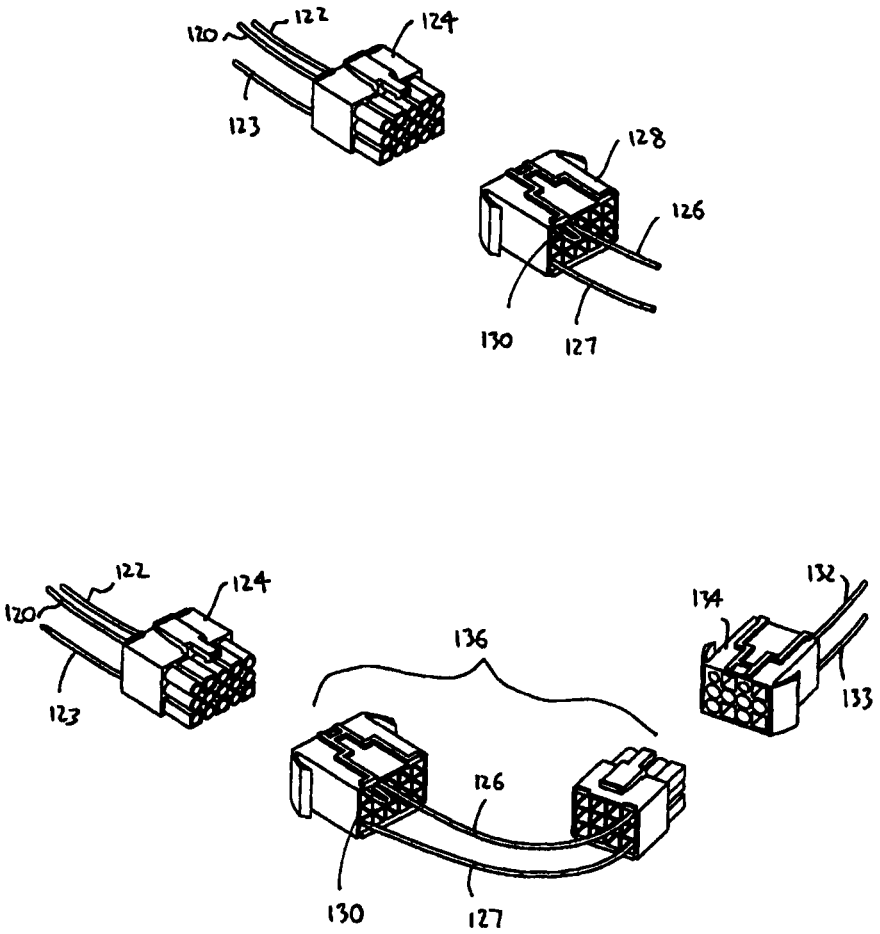
FIG. 13 is a perspective view of a first single control wire loom arrangement.

FIG. 13 shows a first wiring loom arrangement suitable for connecting the lock assembly 20 to a single wire control system, as may already be present in an existing building. The lock control wires 120 and 122 and the common/return/earth wire 123 are terminated in a lock connector plug 124. A single control wire 126 and a common/return/earth wire 127 connects the controller to a connector socket 128. A jumper wire 130 has one end connected to the wire 126 and one end connected to the neighbouring opening in the socket 128. In this way, power can be transmitted from the single control wire 126 to both of the lock control wires 120 and 122 to simultaneously control both the first solenoid 62 and the second solenoid 70.

Alternatively, if an existing single control wire 132, common/return/earth wire 133 and socket 134 are already present in the building and it is desired to not disturb them, an intermediate loom 136, can be connected between the existing socket 134 and the lock connector plug 124.

Figure 14:
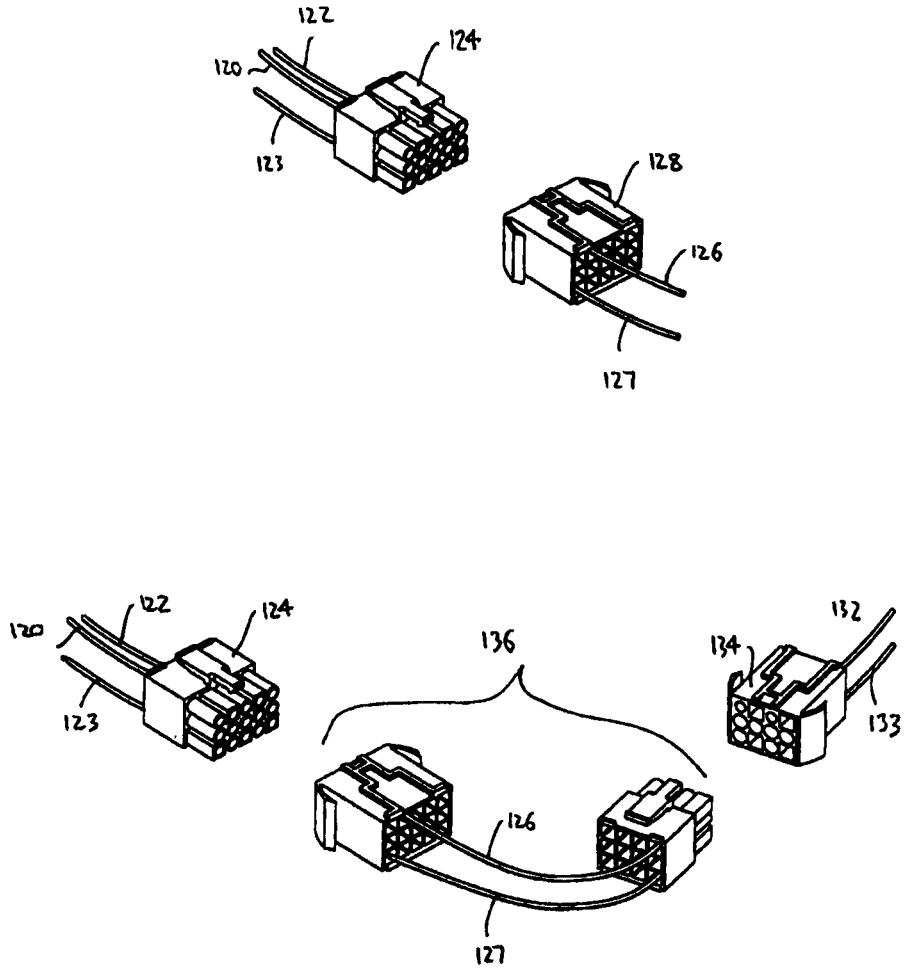
FIG. 14 is a perspective view of a second single control wire loom arrangement.

FIG. 14 shows two similar wiring loom arrangements with like reference numerals indicating like features. However, in this arrangement, the jumper wire is not included and energising the single control wire 126 will only energise the first solenoid 62 only.

Figure 15:
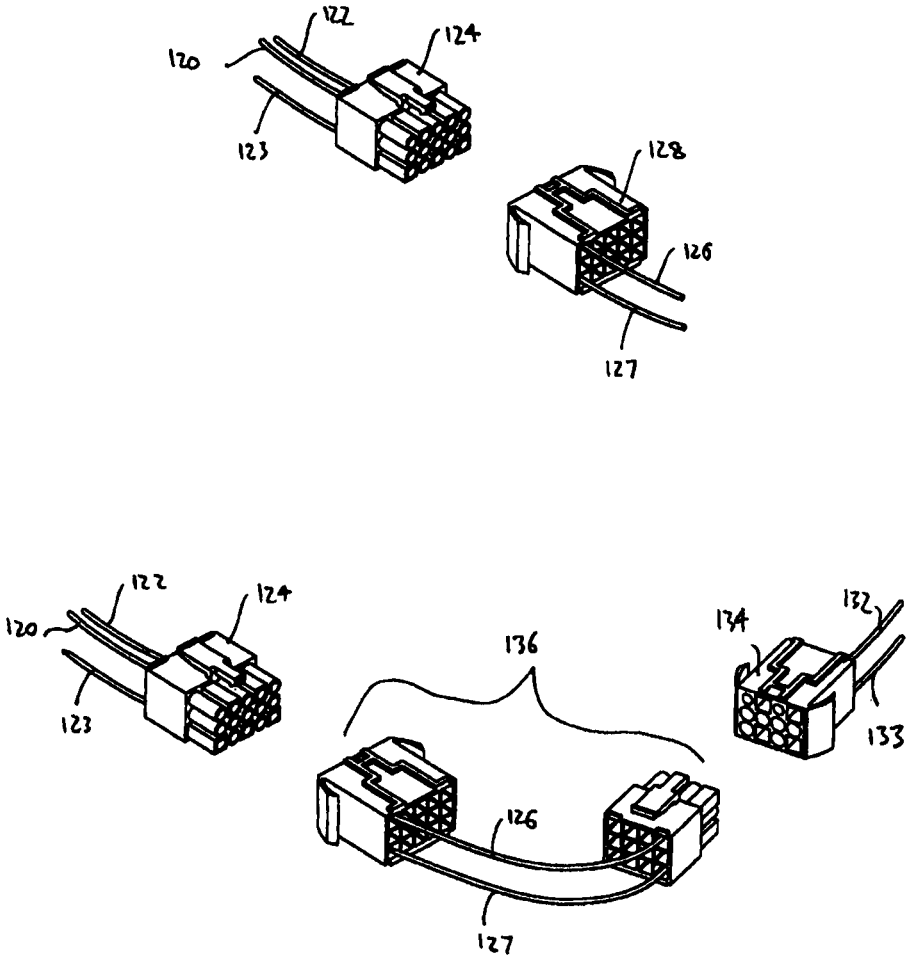
FIG. 15 is a perspective view of a third single control wire loom arrangement.

FIG. 15 shows two similar arrangements to that shown in FIG. 13, except power applied to the single control wire 126 is only transmitted to the second solenoid 70.

Figure 17:
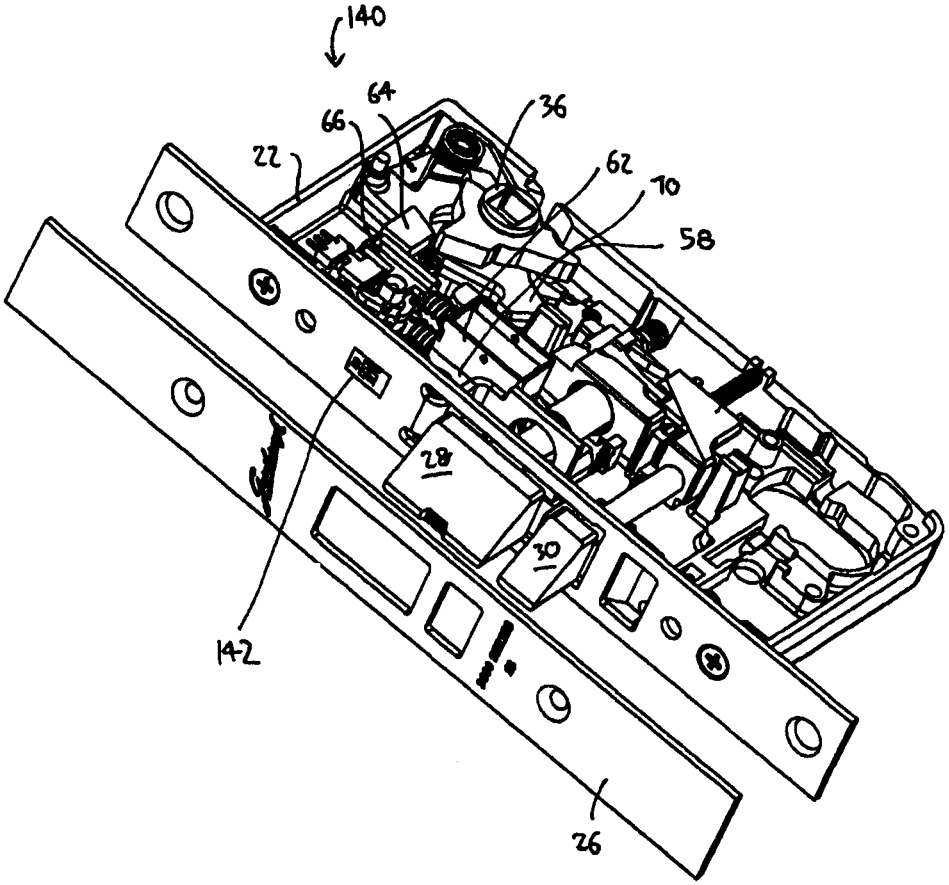
FIG. 17 is a right-hand side perspective view of a second embodiment of an electrically controllable lock assembly, with the side cover removed.
Figure 18:
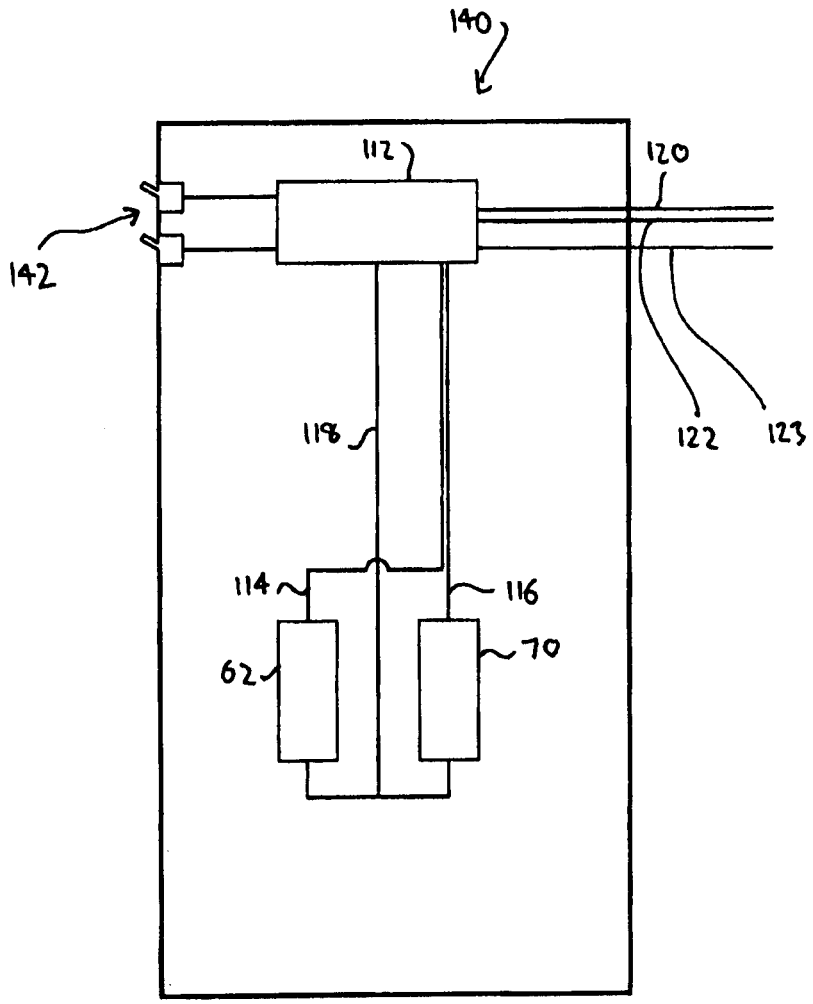
FIG. 18 is a schematic view of the wiring of the lock assembly shown in FIG. 17.

FIGS. 17 and 18 show a second embodiment of an electrically controllable lock assembly 140. The lock assembly 140 is similar to the first embodiment of lock assembly 20 and like reference numerals will be used to indicate like features. However, the lock assembly 140 includes a dip switch arrangement 142 accessible by removal of the face plate 26. The dip switch arrangement 142 is connected to the electronics housing 112. The dip switch arrangement 142 also allows the supply of the driving power to the first solenoid 62, in response to a control signal in the wire 120, to be switched on or off. The dip switch arrangement 142 allows the supply of the driving power to the second solenoid 70, in response to a control signal in the wire 122, to be switched on (i.e. enabled) or off (i.e. disabled). This allows the first solenoid 62 only to be operational or the second solenoid 70 only to be operational or both of the first and second solenoids 62 and 70 to be operational.

The dip switch arrangement 142 also allows the supply of the driving power to be swapped such that the control signal in the wire 122 is communicated to the first solenoid 62 and the control signal in the wire 120 is communicated to the second solenoid 70.

The dip switch arrangement 142 also allows the simultaneous (ie. tandem) control of both of the first and second solenoids 62 and 70 from only one loom control signal from a single wire.

The dip switch assembly 142 conveniently allows some aspects of the lock assembly's 140 functionality to be altered after only removal of the face plate 26 (ie. without requiring removal of the entire lock assembly 140 from the door). The available inside and outside locked/unlocked states when both of the solenoids 62 and 70 are set to operational are the same as those indicated as "2 Wires 2 Solenoids" plus "1 Wire 2 Solenoids" in FIG. 16. The locked/unlocked states available when only one solenoid is set operational is equivalent to that indicated as "1 Wire Work First Side solenoid only" plus "1 Wire Work Second Side solenoid only" in FIG. 16.

The dip switch arrangement 142 is exemplary only and the number of switches used and the wiring arrangement connecting them to other circuitry can be in any other form.

Figure 19:
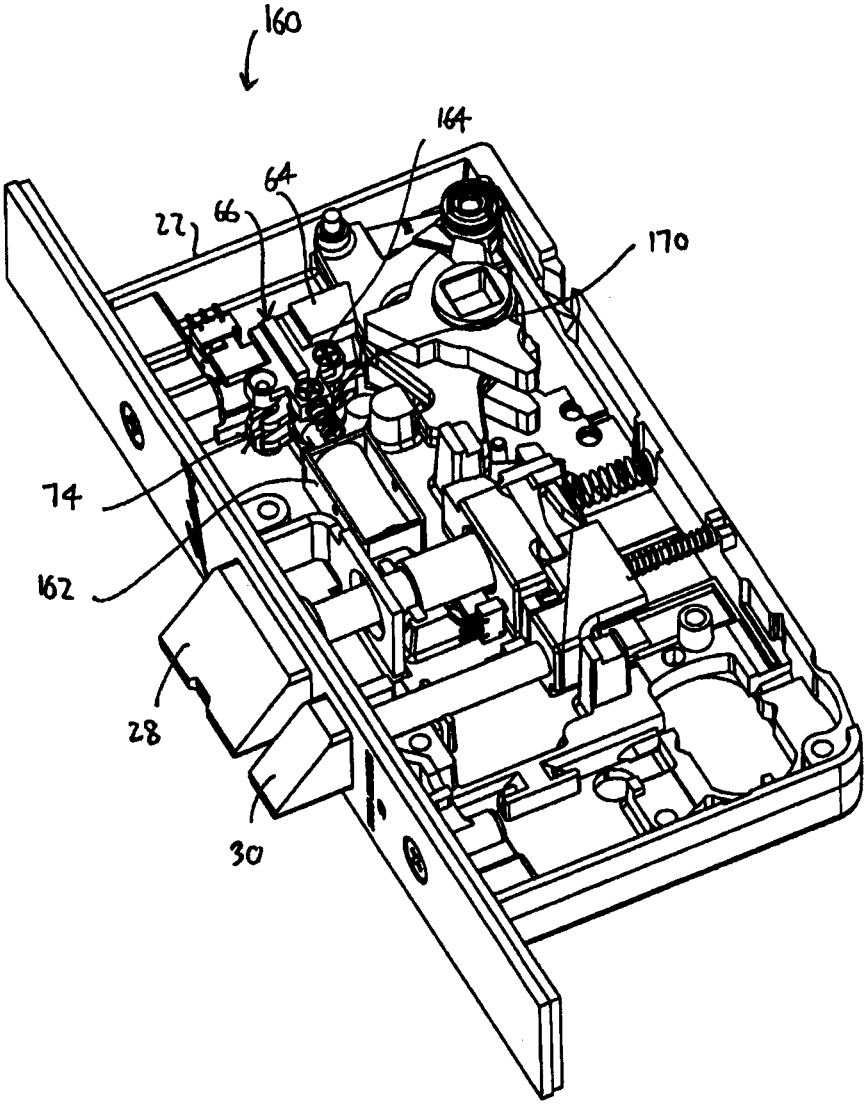
FIG. 19 is a right-hand side perspective view of a third embodiment of an electrically controllable lock assembly, with the side cover and the face plate removed.
Figure 20:
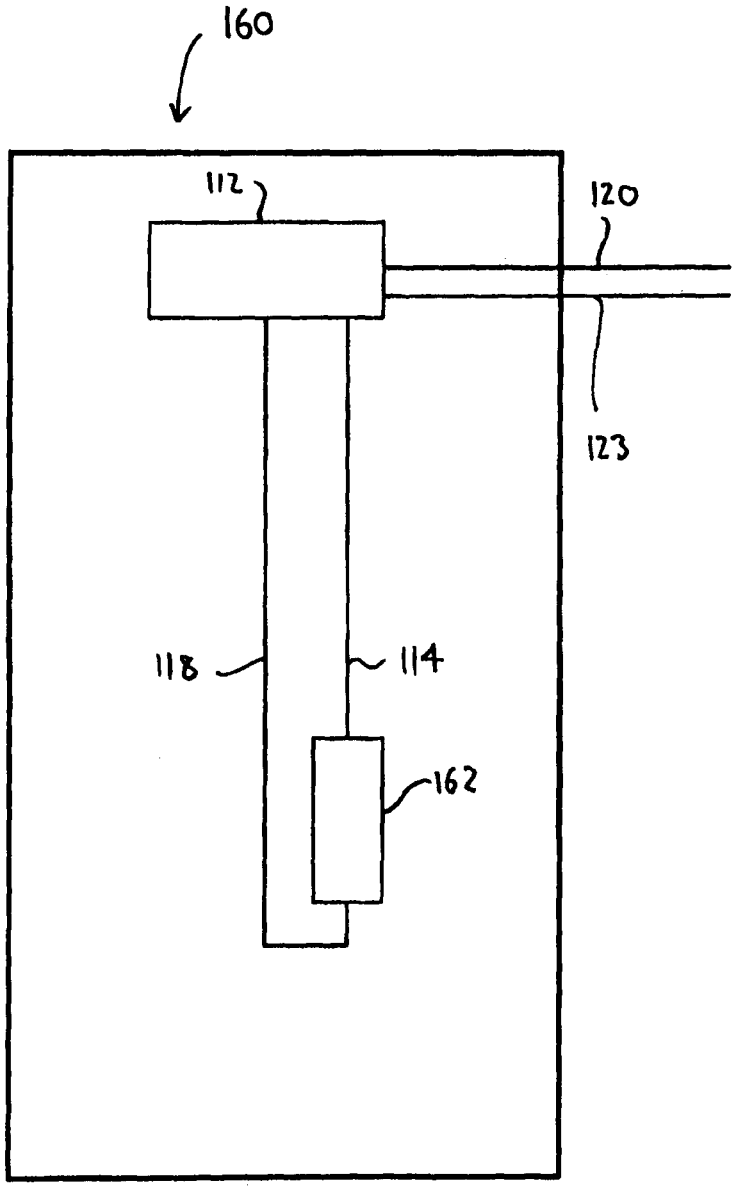
FIG. 20 is a schematic view of the wiring of the lock assembly shown in FIG. 19.

FIGS. 19 and 20 show a third embodiment of electrically controllable lock assembly 160. The lock assembly 160 is similar to the first embodiment of lock assembly 20 previously described and like features will be denoted with like reference numerals. However, in the lock assembly 160, only one solenoid 162 is used to position both of the first and the second hub lockers 64 and 72 via the first and the second motion transfer means 66 and 74 respectively. Further, each of the motion transfer means 66 and 74 are releasably connected to the solenoid 162 by one of two screws 164, one either side of the lock assembly 160. By removing one of the screws 164, one of the motion transfer means can be disconnected from the driver 162 and set to a permanent function.

Further, in previous embodiments, there are a pair of solenoid biasing springs, each mounted adjacent to their respective solenoid, which also act on the motion transfer means connected thereto. In this embodiment, the first motion transfer means 66 includes a first biasing spring 170 connected between the first motion transfer means 66 and the side cover 24. A second biasing spring (not shown) is connected between the second motion transfer means 74 and the housing 22. This allows each of the motion transfer means 66 and 74 to be disconnected from being driven by the solenoid 164 and still be able to be biased to a predetermined position.

The variety of locked/unlocked states provided by the lock assembly 160 is summarised in FIG. 21 and is less than that of the lock assembly 20. However, the lock assembly 160 is less expensive to produce and can be manufactured using a significant amount of common components. The lock assembly 160 is useful for numerous types of installations, particularly those with existing single power wiring. Further, and as is evident from FIG. 21, whilst the variety of locked/unlocked states of the lock assembly 160 is less than that of the lock assembly 20, it is still superior to current electrical mortice locks.

Although the invention has been described with reference to a preferred embodiment, it will be appreciated by persons skilled in the art that the invention may be embodied in many other forms. For example, the lock assembly described above uses pull type solenoids. It is also possible to utilise push type solenoids which extend in the presence of power and are spring retracted in the absence of power. It will be understood that if push solenoids are used, then the motion transfer means are set oppositely to that described above in order to achieve the same fail safe or fail secure setting. In addition, if desired, it is possible to use a push type solenoid on one side of the lock and a pull type solenoid on the other. The dip switch arrangement can also be positioned in areas of the lock housing other than that accessible by removal of the face plate.

In the embodiments shown, the first solenoid and the second solenoid are both positioned within the housing. In alternate forms, one or both of the solenoids can be positioned external the housing and within one or more escutcheons.

The invention claimed is:

1. An electrically controllable lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a first driver electrically controllable to position the first hub locker to thereby selectively prevent or allow movement of the lock bolt in response to torque being applied to the first hub from the first handle; and a second driver electrically controllable to position the second hub locker to thereby selectively prevent or allow movement of the lock bolt in response to torque being applied to the second hub from the second handle, wherein the first hub locker and the first driver are settable as either fail safe—or fail secure and the second hub locker and the second driver are settable as either fail safe or fail secure, and wherein the fail setting of the first hub locker and the first driver and the fail setting of the second hub locker and the second driver are independent of one another.

2. A lock assembly as claimed in claim 1, wherein the first driver and the second driver are electrically controllable independently of one another.

3. A lock assembly as claimed in claim 2, wherein the first driver and the second driver are controllable independently of one another in response to respective first and second power signals each associated with respective first and second control signals.

4. A lock assembly as claimed in claim 1, wherein the first driver and the second driver are electrically controllable in tandem with one another.

5. A lock assembly as claimed in claim 4, wherein the first driver and the second driver are controllable in tandem with one another in response to respective first and second power signals both associated with a single control signal.

6. A lock assembly as claimed in claim 1, wherein the lock assembly is reconfigurable between the first driver and the second driver being electrically controllable independently of one another and the first driver and the second driver being electrically controllable in tandem with one another.

7. A lock assembly as claimed in claim 1, wherein the lock assembly includes a housing and the first driver and the second driver are both positioned within the housing.

8. A lock assembly as claimed in claim 1, wherein the lock assembly is adapted to energise the first and second drivers in response to first and second control signals respectively.

9. An electrically controllable lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a first driver electrically controllable to position the first hub locker to thereby selectively prevent or allow movement of the lock bolt in response to torque being applied to the first hub from the first handle;

a second driver electrically controllable to position the second hub locker to thereby selectively prevent or allow movement of the lock bolt in response to torque being applied to the second hub from the second handle, a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second driver causes the second hub locker to move in a first direction, or a second position in which energising of the second driver causes the second hub locker to move in a second direction, opposite to the first direction.

10. An electrically controllable lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle;

a second hub locker positionable to selectively prevent or allow movement of the lock bolt in response to torque being applied to the second hub from the second handle;

a first driver associated with the first hub locker; and a second driver associated with the second hub locker, wherein only one of the first driver or the second driver is electrically controllable to respectively position the first hub locker or the second hub locker to thereby selectively prevent or allow movement of the lock bolt in response to torque being applied to the first hub from the first handle or to the second hub from the second handle.

11. A lock assembly as claimed in claim 10, wherein the first driver is electrically controllable to position the first hub locker to thereby selectively prevent or allow movement of the lock bolt in response to torque being applied to the first hub from the first handle and the second driver and the second hub locker are set permanently unlocked by being set as fail safe with the second driver unpowered.

12. A lock assembly as claimed in claim 10, wherein the first driver is electrically controllable to position the first hub locker to thereby selectively prevent or allow movement of the lock bolt in response to torque being applied to the first hub from the first handle and the second driver and the second hub locker are set permanently locked by being set as fail secure with the second driver unpowered.

13. A lock assembly as claimed in claim 10, wherein the second driver is electrically controllable to position the second hub locker to thereby selectively prevent or allow movement of the lock bolt in response to torque being applied to the second hub from the second handle and the first driver and the first hub locker are set permanently unlocked by being set as fail safe with the first driver unpowered.

14. A lock assembly as claimed in claim 10, wherein the second driver is electrically controllable to position the second hub locker to thereby selectively prevent or allow movement of the lock bolt in response to torque being applied to the second hub from the second handle and the first driver and the first hub locker are set permanently locked by being set as fail secure with the first driver unpowered.

15. A lock assembly as claimed in claim 10, wherein the lock assembly includes:

a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second driver causes the second hub locker to move in a first direction, or a second position in which energising of the second driver causes the second hub locker to move in a second direction, opposite to the first direction.

16. A lock assembly including:

a lock bolt movable between a latching position and an unlatching position;

a first hub adapted to move the lock bolt in response to movement of a first handle;

a second hub adapted to move the lock bolt in response to movement of a second handle;

a first hub locker positionable to selectively prevent or allow movement of the lock bolt in response to torque being applied to the first hub from the first handle; and a second hub locker positionable to selectively prevent or allow movement of the lock bolt in response to torque being applied to the second hub from the second handle, wherein the first hub locker and the second hub locker are positionable independently of one another, and further wherein the lock assembly includes a first driver electrically controllable to position the first hub locker to thereby selectively prevent or allow movement of the lock bolt in response to torque being applied to the first hub from the first handle and a second driver electrically controllable to position the second hub locker to thereby selectively prevent or allow movement of the lock bolt in response to torque being applied to the second hub from the second handle, and wherein the lock assembly further includes a first motion transfer means between the first driver and the first hub locker, the first motion transfer means being settable in a first position, in which energising of the first driver causes the first hub locker to move in a first direction, or a second position, in which energising of the first driver causes the first hub locker to move in a second direction, opposite to the first direction; and a second motion transfer means between the second driver and the second hub locker, the second motion transfer means being settable in a first position, in which energising of the second driver causes the second hub locker to move in a first direction, or a second position in which energising of the second driver causes the second hub locker to move in a second direction, opposite to the first direction.

17. A lock assembly as claimed in claim 16, wherein the first driver and the second driver are electrically controllable independently of one another.

18. A lock assembly as claimed in claim 16, wherein the first driver and the second driver are controllable independently of one another in response to respective first and second power signals each associated with respective first and second control signals.

19. A lock assembly as claimed in claim 16, wherein the first driver and the second driver are electrically controllable in tandem with one another.

20. A lock assembly as claimed in claim 19, wherein the first driver and the second driver are controllable in tandem with one another in response to respective first and second power signals both associated with a single control signal.

21. A lock assembly as claimed in claim 16, wherein the lock assembly is reconfigurable between the first driver and the second driver being electrically controllable independently of one another and the first driver and the second driver being electrically controllable in tandem with one another.

22. A lock assembly as claimed in claim 16, wherein the lock assembly is adapted to energise the first and second drivers in response to first and second control signals respectively.

* * * * *